US012773759B2

(12) United States Patent
Jhones et al.

(10) Patent No.: US 12,773,759 B2
(45) Date of Patent: Oct. 27, 2026

(54) TOOL SHARPENING APPARATUS WITH VARIABLE EDGE ANGLE CONTROL

(71) Applicant: Spyderco, Inc., Golden, CO (US)

(72) Inventors: Peter H. Jhones, Wellington, CO (US); Michael D. Janich, Longmont, CO (US); Louis Sal Glesser, Evergreen, CO (US)

(73) Assignee: Spyderco, Inc., Golden, CO (US)

( * ) Notice: Subject to any disclaimer, the term of this patent is extended or adjusted under 35 U.S.C. 154(b) by 541 days.

(21) Appl. No.: 18/180,755

(22) Filed: Mar. 8, 2023

(65) Prior Publication Data

US 2023/0302607 A1 Sep. 28, 2023

Related U.S. Application Data

(60) Provisional application No. 63/317,834, filed on Mar. 8, 2022.

(51) Int. Cl.
*B24D 15/06* (2006.01)

(52) U.S. Cl.
CPC ..... *B24D 15/06* (2013.01); *B24D 15/065* (2013.01)

(58) Field of Classification Search
None
See application file for complete search history.

(56) References Cited

U.S. PATENT DOCUMENTS

D116,704 S 9/1939 Conway et al.
D142,880 S 11/1945 Loucony
D153,706 S 5/1949 Lathom
4,231,194 A 11/1980 Glesser
4,259,815 A 4/1981 Kuban
4,450,653 A 5/1984 Fletcher
4,624,079 A * 11/1986 Bonapace ..... B24D 15/081 76/86

(Continued)

FOREIGN PATENT DOCUMENTS

CA 1130567 8/1982
DE 3041584 6/1982

(Continued)

OTHER PUBLICATIONS

English translation of LT-7103-B, dated Nov. 11, 2024.*

(Continued)

*Primary Examiner* — Hwei-Siu C Payer
(74) *Attorney, Agent, or Firm* — Sheridan Ross P.C.

(57) ABSTRACT

A sharpening device is provided that can precisely adjust the angle of sharpening stones for use in a variety of ways and with many different types of knives and tools. The sharpening device has a first holder and a second holder positioned in a base. The first holder, the second holder, and the base may have respective pluralities of apertures, where a single aperture of the holder is aligned with a single aperture of the base at any given time. The first holder and the second holder may include indicia that align with respective apertures of the base. The base may include an angle gauge with a pointer, where the first holder or the second holder may be coupled to each other and/or to the pointer via geared surfaces. The sharpening device may include an actuatable thumb wheel, a base stand, safety rods, and/or securing components.

8 Claims, 22 Drawing Sheets

(56) References Cited

U.S. PATENT DOCUMENTS

| | | | | |
|---|---|---|---|---|
| 4,640,058 | A | 2/1987 | Glesser | |
| D290,222 | S | 6/1987 | Moody | |
| 4,696,129 | A | 9/1987 | Roberts | |
| 4,719,722 | A | 1/1988 | Washburn | |
| 4,751,795 | A | 6/1988 | Jenne | |
| 4,759,153 | A | 7/1988 | Cohen | |
| 4,912,885 | A | 4/1990 | Bonapace | |
| D318,782 | S | 8/1991 | LeBeau | |
| D322,741 | S | 12/1991 | Jenne | |
| D326,989 | S | 6/1992 | Button et al. | |
| D327,402 | S | 6/1992 | Button et al. | |
| D328,847 | S | 8/1992 | Button et al. | |
| D333,081 | S | 2/1993 | Glesser | |
| D337,253 | S | 7/1993 | Glesser | |
| D353,988 | S | 1/1995 | Glesser | |
| 5,458,534 | A | 10/1995 | Campione et al. | |
| 5,477,753 | A | 12/1995 | Branscum et al. | |
| D365,740 | S | 1/1996 | Smith | |
| D367,598 | S | 3/1996 | Fortenberry | |
| D369,081 | S | 4/1996 | Byers et al. | |
| D387,262 | S | 12/1997 | Byers et al. | |
| D394,596 | S | 5/1998 | Byers et al. | |
| D404,278 | S | 1/1999 | Gore | |
| D406,038 | S | 2/1999 | Glesser | |
| 5,928,069 | A | 7/1999 | Glesser | |
| D427,500 | S | 7/2000 | Glesser | |
| D442,052 | S | 5/2001 | Glesser | |
| 7,381,120 | B2 | 6/2008 | Henry | |
| 8,951,098 | B2 | 2/2015 | Jhones | |
| 9,796,068 | B2 | 10/2017 | Jhones | |
| 2009/0275272 | A1* | 11/2009 | Bonapace | B24D 15/082 51/293 |
| 2023/0302607 | A1* | 9/2023 | Glesser | B24D 15/06 |

FOREIGN PATENT DOCUMENTS

| | | | | |
|---|---|---|---|---|
| GB | 2084058 | | 4/1982 | |
| LT | 7103 B | * | 11/2024 | B24D 15/08 |
| WO | WO-2024189421 A1 | * | 9/2024 | B24D 15/08 |

OTHER PUBLICATIONS

Delavigne, "The Spyderco Story, The New Shape of Sharp," Paladin Enterprises, Inc., 2000, pp. 176-208.

"Ceramic Stick Sharpener," A.G. Russell Catalog, no date, in Office Action for U.S. Appl. No. 29/082,235 mailed Aug. 12, 1998, p. 35.

"Lansky Crock Pack Sharpener," Atlanta Cutlery Catalog, Spring 1996, p. 150.

Official Action for U.S. Appl. No. 29/082,235 mailed Aug. 12, 1998, 5 pages.

Notice of Allowance for U.S. Appl. No. 29/082,235 mailed Oct. 9, 1998, 3 pages.

Official Action for U.S. Appl. No. 29/103,288 mailed Aug. 26, 1999, 5 pages.

Notice of Allowance for U.S. Appl. No. 29/103,288 mailed Nov. 15, 1999, 3 pages.

Official Action for U.S. Appl. No. 13/691,032, mailed Jun. 13, 2014, 6 pages.

Notice of Allowance for U.S. Appl. No. 13/691,032, mailed Sep. 26, 2014, 5 pages.

Official Action for U.S. Appl. No. 14/619,057, mailed Jan. 10, 2017, 6 pages.

Notice of Allowance for U.S. Appl. No. 14/619,057, mailed Jun. 21, 2017, 6 pages.

* cited by examiner

TOOL SHARPENING APPARATUS WITH VARIABLE EDGE ANGLE CONTROL

CROSS-REFERENCE TO RELATED APPLICATIONS

This application claims priority to U.S. Provisional Patent Application Ser. No. 63/317,834, filed Mar. 8, 2022, entitled "TOOL SHARPENING APPARATUS WITH VARIABLE EDGE ANGLE CONTROL," the entire disclosure of which is hereby expressly incorporated by reference in its entirety.

FIELD

The present disclosure is related to tool sharpening devices and specifically to sharpening devices that orient sharpening stones or other sharpening materials at varying angles.

BACKGROUND

Cutting instruments have been used for centuries by craftsmen, hunters, and others requiring a sharp cutting instrument. Fixed blade knives are commonly used for cutting through foliage, cutting food, and other uses that subject the blade to wear. Folding knives are commonly carried by sportsmen, craftsmen, and other users who desire a compact and portable knife with a blade that can be safely folded for carrying in a pocket or attached to a belt. These folding knives are also used for cutting various materials and experience wear and tear during use. Scissors and other tools that have a sharp edge for cutting, shaving, sawing, or other uses, also need to be routinely sharpened in order for the tool edge to function properly.

Traditionally, sharpening devices such as whetstones, leather strops, and sharpening stones have been used to sharpen an edge of a knife blade. The traditional sharpening process usually incorporates multiple sharpening devices where, for example, an initial whetstone has a coarse roughness or grit to begin sharpening the edge of the knife blade and reduce or eliminate any major nicks or imperfections in the edge. Then, one or more subsequent whetstones with a finer coarseness or grit is used to more finely sharpen the edge of the knife blade. Finally, a leather strop can be used against the edge to finish the sharpening process. These sharpening devices are typically laid flat on a surface, or hung in the case of a leather strop, and the user moves the knife or tool blade against the sharpening device. The result of a traditional sharpening process can be an extremely sharp edge. However, the user must have some threshold of skill and physical dexterity to consistently hold the knife at a particular angle and work the edge against the sharpening device during sharpening, and such skill can take considerable time to develop. Additionally, getting the exact desired edge angle is difficult with existing sharpeners.

Some newer knife sharpeners incorporate sharpening stones with an elongated shape that are held in a base, and a user moves the edge of a knife blade onto the sharpening stone to sharpen the edge of the blade. The user only has to draw the knife blade downward in a vertical direction to sharpen the edge and, thus, less skill and dexterity is required to use these devices. However, these sharpening devices typically hold the sharpening stones at only one or two angles and, therefore, it is difficult to sharpen an edge to varying sharpening angles. In addition, with relatively few angles to choose from, it is difficult for a user to achieve a sharpened edge or use the sharpening device for many different knives and tools, which may require a wide range of sharpening angles. For example, kitchen knives may include blade edge angles that range between 15 and 22 degrees, pocketknives may have blade edge angles that range between 18 and 30 degrees, and outdoor camping tools or bush tools may have edge angles that range between 25 and 35 degrees. By way of another example, a straight or plain edge blade may include a blade edge with a substantially symmetrical set of angles or have one angle edge on one side of the blade and another angle edge on the other side of the blade, while a serrated blade may include a blade edge with non-symmetrical angles. Further still, different types of knives and tools may be originally manufactured with an edge having a particular angle that does not match the angle or angles of the newer sharpening devices. Thus, use of the knife or tool with the newer sharpening device ruins the original blade angle and possibly the intended functionality of the knife or tool.

SUMMARY

The present disclosure provides a sharpening device that can be used with a relatively low amount of skill and dexterity but can be adjusted to provide a wide range of sharpening angles for use with many different knives, blades, and tools. The sharpening device can also assist a user in sharpening the edge of a blade to a specific desired angle, where the specific angle can be varied from knife to knife or tool to tool using the same sharpening device. The sharpening device can have one or more elongated sharpening stones set within respective holders, and the holders are rotatable relative to a base about a respective axis through the holder and sidewalls of the base. As discussed herein, the holders and the base have features that allow the sharpening stones and holders to be locked at many different angles relative to the base.

It is an aspect of embodiments of the present disclosure to provide apertures or recesses in each of the base and the holder for the sharpening stone such that the holder can be locked at many different angles relative to the base. In some embodiments, one set of apertures extends through a portion of the base, and another set of apertures or recesses extends into the holder. Each set of apertures or recesses is arranged in a respective circular pattern about a center point of a definable circle but the sets of apertures are arranged with a different pitch between adjacent apertures, where pitch is defined in the present disclosure as a central angle between adjacent apertures in each set of apertures (or an angle whose apex or vertex is the respective center point of the definable circle having a select radius measured between the center point of the definable circle and a center point of each aperture, where the center of each adjacent aperture is located on the definable circle at a distance equal to the select radius). In other words, the pitch between apertures of the base is different than the pitch between apertures of the holder. Thus, one aperture of the base and one aperture of the holder are aligned at one sharpening angle, and a setting device (e.g., a pin, screw, or the like) can extend through these aligned apertures to lock the position of the holder relative to the base and establish the sharpening angle of the sharpening stone. Then, to change the sharpening angle, the setting device is removed, and the holder is rotated until a different aperture of the holder is aligned with a different aperture of the base. The setting device extends into these newly aligned apertures to lock the holder in a new position and set a new sharpening angle. This relationship allows the sharpening angle to be adjusted in small increments and then securely held in place at the desired angle. Thus, a user can achieve a finer edge, like traditional sharpening methods, with a more accurate edge angle and with relatively low skill and dexterity. Additionally, the user can use the sharpening device with a variety of knives and tools that require different sharpening angles.

It is a further aspect of embodiments of the present disclosure to provide a sharpening device that has a second holder that receives a second sharpening stone in an opposing relationship with the first holder and first sharpening stone. Together, the first and second holders are rotatably disposed within the base, and a geared surface of the first holder engages an opposing geared surface of the second holder. Thus, as the first holder rotates in the base, the second holder rotates in an opposing direction, and vice versa. A user can lock the position of the first holder and the sharpening angle as described herein, and the second holder and the second sharpening stone are locked at an opposing angle. Then, a user can sharpen one side of the edge on one sharpening stone and sharpen the other side of the edge on the other sharpening stone. As a result, the user can simply draw the knife downward in a vertical direction on one sharpening stone and then move the knife a few inches to draw the knife downward in a vertical direction on the other sharpening stone for a balanced sharpening process.

It is another aspect of embodiments of the present disclosure to provide one or more gauge plates that are positionable with respect to the base and holders for the sharpening stones. For example, the one or more gauge plates may include a gauge plate that extends from the base, where the plate identifies the orientation of the sharpening stones held in the holders with various indicia. The indicia can identify a vertical plane extending through the sharpening device between the two holders, and then the indicia can identify various angles that the holders can be positioned relative to the vertical plane. The indicia can identify a plurality of angles due to the precise adjustment of the holders as provided by the present disclosure. By way of another example, the one or more gauge plates may include a plurality of gauge plates that are each pre-cut to correspond to a particular angle. Each pre-cut gauge plate of the plurality of gauge plates may be positioned on the holders and/or the sharpening stones within the holders, to indicate whether the sharpening stones and holders are at the particular angle represented by the pre-cut gauge plate.

It is another aspect of embodiments of the present disclosure to provide a set of angle indicators which are visible from within the base. The set of angle indicators are positioned on the sharpening stone holders within the base. The set of angle indicators are visible through apertures in the base. Movement of a first holder is transferred to a second holder via a gear surface on each of the first holder and the second holder. The base may be transparent or translucent.

It is another aspect of embodiments of the present disclosure to provide a set of angle indicators on an angle gauge on an exterior of the base. The first holder and the second holder are coupled to a pointer on the angle gauge via a gearing assembly. Actuation of the holder causes the pointer to move or otherwise adjust from a first angle indicator to a second angle indicator via the gearing assembly. In some embodiments, movement of the first holder is transferred to the second holder via a gear surface on each of the first holder and the second holder, and movement of the pointer is transferred from a gear surface of the first holder or the second holder via a pointer gear on a pointer axle coupled to the pointer.

It is another aspect of embodiments of the present disclosure that the first holder and the second holder are coupled to a thumb screw or thumb wheel. In some embodiments, the thumb screw or thumb wheel is coupled to the pointer on the angle gauge via the gearing assembly. Actuation of the thumb screw or thumb wheel, either in addition to or instead of actuation of the holder, causes the pointer to move on the angle gauge from a first angle indicator to a second angle indicator via the gearing assembly. In general, actuation of the thumb screw or thumb wheel may cause the angles of the sharpening stones to change from a first angle to a second angle, which may be observable via alignment of the sharpening stones with a gauge plate and/or corresponding indicia on a gauge plate, alignment with angle indicators viewable through base apertures, and/or alignment of a pointer with angle indicators on an angle gauge.

It is another aspect of embodiments of the present disclosure to include securing components. In some embodiments, the securing components couple to couplers that are passed through apertures in the holders and the base. The securing components are operable to prevent the holders from rotating relative to the base when in a locked configuration. For example, where the securing components are knobs threaded onto the couplers, the knobs may be tightened against the base to prevent rotation of the holders when in the locked configuration.

It is another aspect of embodiments of the present disclosure to provide safety rods or similar hand guards that engage with the base and/or a base stand. For example, the base and/or the base stand may include apertures operable to receive the safety rods, which may extend in a direction at least one of outward and upward from the base, and which may be fabricated from a material able to prevent a tool edge from engaging with a hand of a user. The safety rods or hand guards may protect a hand of the user from accidental contact by the knife (e.g., the hand holding the base and/or base stand in place on a working surface).

It is another aspect of embodiments of the present disclosure to provide a base stand for the base. The base stand includes multiple components which connect together around the base. For example, the base may include one or more dimensions which correspond to dimensions (e.g., of defined cavities, outer perimeters, or the like) of the base stand, such that the base may be selectively retained within the base stand. The base stand is adaptable to receive and house additional or extra components for the sharpening device, including sharpening stones, safety rods, gauge plates, or other components configured for use with the sharpening device. For example, the gauge plates may each include an outer perimeter that fits within and is selectively removable from an outer perimeter of or defined cavity within the base stand.

It will be appreciated that the term "sharpening stone" can refer to any object that is intended to sharpen an edge of another object such as a knife. It will also be appreciated that while embodiments of the present disclosure are described with respect to fixed or folding knives, any tool or implement can be used with the embodiments described herein. Other tools or implements that require sharpening can include a saw blade, a drill bit, a razor, a card scraper, a spindle gouge, a chisel, a broadhead or other arrowhead, etc.

One particular embodiment of the present disclosure is a sharpening device for sharpening a blade of a tool, including a base having a bottom surface, a sidewall with a first plurality of apertures extending through a first portion of the sidewall, and a first center aperture, wherein the first plurality of apertures is arranged in a first circle having a first radius and the first center aperture is positioned at a first center point of the first circle; a vertical plane positioned substantially perpendicular to the bottom surface of the base; a first holder having a first recess configured to receive a first sharpening stone, a second plurality of apertures extending into a side portion of the first holder, and a second center aperture, wherein the second plurality of apertures are arranged in a second circle having a second radius and the second center aperture is positioned at a second center point of the second circle, wherein the first radius is equal to the second radius, and wherein the first sharpening stone is capable of being set at a first angle relative to the vertical plane via rotation of the first holder about a first rotation axis; a first coupler extending through the second center aperture of the first holder and the first center aperture of the base such that the first holder is rotatable relative to the base about the first coupler and the first rotation axis, wherein when the first sharpening stone is positioned at the first angle relative to the vertical plane one aperture of the first plurality of apertures is aligned with one aperture of the second plurality of apertures; a second holder having a second recess configured to receive a second sharpening stone, the second holder having a third center aperture, wherein the second sharpening stone is capable of being set at a second angle relative to the vertical plane via rotation of the second holder; and a second coupler extending through the third center aperture of the second holder and a fourth center aperture of the base such that the second holder is rotatable relative to the base about the second coupler and the second rotation axis.

In some embodiments, the first center point of the first circle and the second center point of the second circle are aligned with the first rotation axis of the first holder. In some embodiments, the second holder has a third plurality of apertures and the base has a fourth plurality of apertures, the third plurality of apertures are arranged in a third circle having a third radius, the fourth plurality of apertures are arranged in a fourth circle having a fourth radius, the third radius is equal to the fourth radius, and when the second sharpening stone is positioned at the second angle relative to the vertical plane one aperture of the third plurality of apertures is aligned with one aperture of the fourth plurality of apertures.

In some embodiments, the first holder includes a first geared surface that is operable to engage with a second geared surface of the second holder, wherein rotation of the first holder in one direction relative to the vertical plane causes rotation of the second holder in an opposing direction relative to the base when the first geared surface is engaged with the second geared surface, and wherein the second angle of the second sharpening stone is equal and opposite to the first angle of the first sharpening stone relative to the vertical plane. In other embodiments, the first holder includes a first geared surface that is operable to engage with a second geared surface of the second holder, wherein rotation of the first holder in one direction relative to the vertical plane causes rotation of the second holder in an opposing direction relative to the base when the first geared surface is engaged with the second geared surface, and wherein the second angle of the second sharpening stone is different from the first angle of the first sharpening stone relative to the vertical plane.

In some embodiments, the sharpening device further comprises a first securing component couplable to the first coupler and a second securing component couplable to the second coupler, wherein each securing component has a first position where the first holder is able to rotate and a second position where the first holder is not able to rotate. In some embodiments, the sharpening device further comprises at least one of a gauge plate coupled to the base, wherein the gauge plate has indicia that identifies the first angle, the second angle, or a combination of the first angle and the second angle; or a plurality of gauge plates operable to be positioned proximate to the first sharpening stone and the second sharpening stone, wherein each gauge plate of the plurality of gauge plates is dimensioned to identify said the angle, the second angle, or a combination of the first angle and the second angle.

In some embodiments, the sharpening device further comprises a base stand including a cavity dimensioned to receive a bottom portion of the base. In some embodiments, the sharpening device further comprises at least one safety rod that extends outwardly and upwardly from the base to prevent a tool edge from engaging with a hand of a user.

In some embodiments, at least one of the first holder and the second holder comprises indicia on an exterior surface, wherein the base further comprises at least one base aperture, and wherein the indicia on the exterior surface of the at least one of the first holder and the second holder are operable to align with the at least one base aperture. In some embodiments, the base comprises an angle gauge with a plurality of angle indicators and a pointer coupled to a pointer axle, wherein the pointer axle is operable to engage with at least one of the first holder and the second holder, wherein rotation of at least one of the first holder and the second holder causes the pointer axle to rotate and adjust the pointer to align with an angle indicator of the plurality of angle indicators, and wherein the angle indicator corresponds to the first angle, the second angle, or a combination of the first angle and the second angle.

In some embodiments, adjacent apertures of the first plurality of apertures are offset by a first pitch, and adjacent apertures of the second plurality of apertures are offset by a second pitch. In some embodiments, the first pitch is different from the second pitch. In some embodiments, adjacent apertures of the third plurality of apertures are offset by a third pitch, and adjacent apertures of the fourth plurality of apertures are offset by a fourth pitch. In some embodiments, the third pitch is different from the fourth pitch.

Another particular embodiment of the present disclosure is a sharpening device for sharpening a blade of a tool, including a base having a bottom surface and a sidewall with a plurality of base apertures, a first center aperture, and a second center aperture; a vertical plane positioned substantially perpendicular to the bottom surface of the base; a first holder having a third center aperture and a first recess configured to receive a first sharpening stone, wherein the first holder includes a first set of indicia on a first exterior surface, and wherein the first sharpening stone is capable of being set at a first angle relative to the vertical plane via rotation of the first holder about a first rotation axis; a first coupler extending through the third center aperture of the first holder and the first center aperture of the base such that the first holder is rotatable relative to the base about the first coupler and the first rotation axis, wherein the first set of indicia on the first exterior surface of the first holder is alignable with a first base aperture of the plurality of base apertures when setting the first angle of the first sharpening stone relative to the vertical plane; a second holder having a fourth center aperture and a second recess configured to receive a second sharpening stone, wherein the second sharpening stone is capable of being set at a second angle relative to the vertical plane via rotation of the second holder about a second rotation axis; and a second coupler extending through the fourth center aperture of the second holder and the second center aperture of the base such that the second holder is rotatable relative to the base about the second coupler and the second rotation axis.

In some embodiments, the second holder includes a second set of indicia on a second exterior surface, wherein the second set of indicia on the second exterior surface of the second holder is alignable with a second base aperture of the plurality of base apertures when setting the second angle of the second sharpening stone relative to the vertical plane.

In some embodiments, the base comprises a first plurality of apertures arranged in a first circle having a first radius with either the first center aperture or the second center aperture positioned at a first center point of the first circle, wherein either the first holder or the second holder comprises a second plurality of apertures arranged in a second circle having a second radius with the respective third center aperture or fourth center aperture positioned at a second center point of the second circle, wherein the first radius is equal to the second radius, wherein when the first sharpening stone is positioned at the first angle relative to the vertical plane one aperture of the first plurality of apertures is aligned with one aperture of the second plurality of apertures. In some embodiments, the base comprises an angle gauge with a plurality of angle indicators and a pointer coupled to a pointer axle, wherein the pointer axle is operable to engage with at least one of the first holder and the second holder, wherein rotation of at least one of the first holder and the second holder causes the pointer axle to rotate and adjust the pointer to align with an angle indicator of the plurality of angle indicators, and wherein the angle indicator corresponds to the first angle, the second angle, or a combination of the first angle and the second angle.

Another particular embodiment of the present disclosure is a sharpening device for sharpening a blade of a tool, including a base having a bottom surface and a sidewall with a first center aperture, and a second center aperture, and an angle gauge including a plurality of angle indicators and a pointer coupled to a pointer axle; a vertical plane positioned substantially perpendicular to the bottom surface of the base; a first holder having a third center aperture and a first recess configured to receive a first sharpening stone, wherein the first sharpening stone is capable of being set at a first angle relative to the vertical plane via rotation of the first holder about a first rotation axis; a first coupler extending through the third center aperture of the first holder and the first center aperture of the base such that the first holder is rotatable relative to the base about the first coupler and the first rotation axis; a second holder having a fourth center aperture and a second recess configured to receive a second sharpening stone, wherein the second sharpening stone is capable of being set at a second angle relative to the vertical plane via rotation of the second holder about a second rotation axis; and a second coupler extending through the fourth center aperture of the second holder and the second center aperture of the base such that the second holder is rotatable relative to the base about the second coupler and the second rotation axis, wherein the pointer axle is operable to engage with at least one of the first holder and the second holder, wherein rotation of at least one of the first holder and the second holder causes the pointer axle to rotate and adjust the pointer to align with an angle indicator of the plurality of angle indicators, and wherein the angle indicator corresponds to the first angle, the second angle, or a combination of the first angle and the second angle.

In some embodiments, the sharpening device further includes a pointer gear positioned on the pointer axle, wherein the pointer gear is operable to engage with a first geared surface of the first holder or a second geared surface of the second holder to rotate and adjust the pointer to align with the angle indicator of the plurality of angle indicators via rotation of the pointer axle. In some embodiments, the sharpening device further includes a thumb wheel coupled to at least one of the first holder and the second holder, wherein rotating the thumb wheel causes at least one of the first holder and the second holder to rotate and adjust at least one of the first angle of at least one of the first sharpening stone and the second angle of the second sharpening stone relative to the vertical plane.

In some embodiments, the base comprises a first plurality of apertures arranged in a first circle having a first radius with either the first center aperture or the second center aperture positioned at a first center point of the first circle, wherein either of the first holder or the second holder comprises a second plurality of apertures arranged in a second circle having a second radius with the respective third center aperture or fourth center aperture positioned at a second center point of the second circle, wherein when the first sharpening stone is positioned at the first angle relative to the vertical plane one aperture of the first plurality of apertures is aligned with one aperture of the second plurality of apertures.

In some embodiments, at least one of the first holder and the second holder comprises indicia on an exterior surface, wherein the base further comprises at least one base aperture, and wherein the indicia on the exterior surface of the at least one of the first holder and the second holder are operable to align with the at least one base aperture.

Another particular embodiment of the present disclosure is a sharpening device for sharpening a blade of a tool, including a base having a bottom surface and a sidewall with a first center aperture and a second center aperture; a vertical plane positioned substantially perpendicular to the bottom surface of the base; a first holder having a third center aperture and a first recess configured to receive a first sharpening stone and a first geared surface, wherein the first sharpening stone is capable of being set at a first angle relative to a vertical plane via rotation of the first holder about a first rotation axis; a first coupler extending through the third center aperture of the first holder and the first center aperture of the base such that the first holder is rotatable relative to the base about the first coupler and the first rotation axis; a second holder having a fourth center aperture and a second recess configured to receive a second sharpening stone and a second geared surface, wherein the second sharpening stone is capable of being set at a second angle relative to the vertical plane via rotation of the second holder about a second rotation axis; and a second coupler extending through the fourth center aperture of the second holder and the second center aperture of the base such that the second holder is rotatable relative to the base about the second coupler and the second rotation axis, wherein the second geared surface is operable to engage with the first geared surface, wherein rotation of the first holder in one direction relative to the base causes rotation of the second holder in an opposing direction relative to the base when the first geared surface is engaged with the second geared surface.

In various embodiments, the second geared surface of the second holder corresponds to the first geared surface of the first holder such that the second angle of the second sharpening stone is equal and opposite to the first angle of the first sharpening stone relative to the vertical plane. In other embodiments, the second geared surface of the second holder corresponds to the first geared surface of the first holder such that the second angle of the second sharpening stone is different from the first angle of the first sharpening stone relative to the vertical plane.

Another particular embodiment of the present disclosure is a sharpening device for sharpening a blade of a tool, including a base having a bottom surface and a sidewall with a first center aperture and a second center aperture; a vertical plane positioned substantially perpendicular to the bottom surface of the base; a first holder having a third center aperture and a first recess configured to receive a first sharpening stone, wherein the first sharpening stone is capable of being set at a first angle relative to a vertical plane via rotation of the first holder about a first rotation axis; a first coupler extending through the third center aperture of the first holder and the first center aperture of the base such that the first holder is rotatable relative to the base about the first coupler and the first rotation axis; a first securing component couplable to the first coupler; a second holder having a fourth center aperture and a second recess configured to receive a second sharpening stone, wherein the second sharpening stone is capable of being set at a second angle relative to the vertical plane via rotation of the second holder about a second rotation axis; a second coupler extending through the third center aperture of the second holder and the first center aperture of the base such that the second holder is rotatable relative to the base about the second coupler and the second axis; and a second securing component couplable to the second coupler, wherein each securing component has a first position where the first holder is able to rotate and a second position where the first holder is not able to rotate.

Another particular embodiment of the present disclosure is a sharpening device for sharpening a blade of a tool, including a base having a bottom surface and a sidewall with a first center aperture and a second center aperture; a vertical plane positioned substantially perpendicular to the bottom surface of the base; a first holder having a third center aperture and a first recess configured to receive a first sharpening stone, wherein the first sharpening stone is capable of being set at a first angle relative to a vertical plane via rotation of the first holder about a first rotation axis; a first coupler extending through the third center aperture of the first holder and the first center aperture of the base such that the first holder is rotatable relative to the base about the first coupler and the first rotation axis; a second holder having a fourth center aperture and a second recess configured to receive a second sharpening stone, wherein the second sharpening stone is capable of being set at a second angle relative to the vertical plane via rotation of the second holder about a second rotation axis; a second coupler extending through the third center aperture of the second holder and the first center aperture of the base such that the second holder is rotatable relative to the base about the second coupler and the second axis; and at least one gauge plate operable to identify the first angle, the second angle, or a combination of the first angle and the second angle.

In various embodiments, the at least one gauge plate is coupled to the base, and wherein the gauge plate has indicia that identifies the first angle, the second angle, or the combination of the first angle and the second angle. In other embodiments, the at least one gauge plate includes a plurality of gauge plates, wherein the plurality of gauge plates are operable to be positioned proximate to the first sharpening stone and the second sharpening stone, wherein each gauge plate of the plurality of gauge plates is dimensioned to identify the first angle, the second angle, or the combination of the first angle and the second angle. In some embodiments, each gauge plate of the plurality of gauge plates represent a different angle.

Another particular embodiment of the present disclosure is a sharpening device for sharpening a blade of a tool, including a base having a bottom surface and a sidewall with a first center aperture and a second center aperture; a vertical plane positioned substantially perpendicular to the bottom surface of the base; a first holder having a third center aperture and a first recess configured to receive a first sharpening stone, wherein the first sharpening stone is capable of being set at a first angle relative to a vertical plane via rotation of the first holder about a first rotation axis; a first coupler extending through the third center aperture of the first holder and the first center aperture of the base such that the first holder is rotatable relative to the base about the first coupler and the first rotation axis; a second holder having a fourth center aperture and a second recess configured to receive a second sharpening stone, wherein the second sharpening stone is capable of being set at a second angle relative to the vertical plane via rotation of the second holder about a second rotation axis; a second coupler extending between the second holder and the base such that the second holder is rotatable relative to the base about a second rotation axis through the second coupler; and a thumb wheel coupled to at least one of the first holder and the second holder, wherein rotating the thumb wheel causes at least one of the first holder and the second holder to rotate and adjust at least one of the first angle of at least one of the first sharpening stone and the second angle of the second sharpening stone relative to the vertical plane.

Another particular embodiment of the present disclosure is a sharpening device for sharpening a blade of a tool, including a base having a bottom surface and a sidewall with a first center aperture and a second center aperture; a vertical plane positioned substantially perpendicular to the bottom surface of the base; a first holder having a third center aperture and a first recess configured to receive a first sharpening stone, wherein the first sharpening stone is capable of being set at a first angle relative to a vertical plane via rotation of the first holder about a first rotation axis; a first coupler extending through the third center aperture of the first holder and the first center aperture of the base such that the first holder is rotatable relative to the base about the first coupler and the first rotation axis; a second holder having a fourth center aperture and a second recess configured to receive a second sharpening stone, wherein the second sharpening stone is capable of being set at a second angle relative to the vertical plane via rotation of the second holder about a second rotation axis; a second coupler extending through the third center aperture of the second holder and the first center aperture of the base such that the second holder is rotatable relative to the base about the second coupler and the second axis; and a base stand including a cavity dimensioned to receive a bottom portion of the base.

In some embodiments, the base stand is comprised of a first stand portion and a second stand portion, and wherein the first stand portion and the second stand portion are couplable together to secure the base stand within the cavity. In additional embodiments, a first portion of the cavity is defined in the first stand portion, and a second portion of the cavity is defined in the second stand portion.

Another particular embodiment of the present disclosure is a sharpening device for sharpening a blade of a tool, including a base having a bottom surface and a sidewall with a first center aperture and a second center aperture; a vertical plane positioned substantially perpendicular to the bottom surface of the base; a first holder having a third center aperture and a first recess configured to receive a first sharpening stone, wherein the first sharpening stone is capable of being set at a first angle relative to a vertical plane via rotation of the first holder about a first rotation axis; a first coupler extending through the third center aperture of the first holder and the first center aperture of the base such that the first holder is rotatable relative to the base about the first coupler and the first rotation axis; a second holder having a fourth center aperture and a second recess configured to receive a second sharpening stone, wherein the second sharpening stone is capable of being set at a second angle relative to the vertical plane via rotation of the second holder about a second rotation axis; a second coupler extending through the third center aperture of the second holder and the first center aperture of the base such that the second holder is rotatable relative to the base about the second coupler and the second axis; and at least one safety rod that extends in a direction outwardly and upwardly from the base to prevent a tool edge from engaging with a hand of a user.

Another particular embodiment of the present disclosure is a sharpening device for adjusting a sharpening stone or multiple sharpening stones, including a base having a first plurality of apertures extending through a portion of the base, wherein the first plurality of apertures are arranged in a first definable circle having a first radius; a holder having a recess configured to receive a sharpening stone, and the holder having a second plurality of apertures extending into a portion of the holder, wherein the second plurality of apertures are arranged in a second definable circle having a second radius, wherein the first radius is equal to the second radius; and a coupler extending between the holder and the base such that the holder is rotatable relative to the base, wherein a center of the first definable circle and a center of the second definable circle are aligned with a rotation axis of the coupler, and wherein an aperture of the first plurality of apertures and an aperture of the second plurality of apertures are alignable to receive a setting device when setting an angle of the sharpening stone relative to a definable vertical plane.

In some embodiments, adjacent apertures of said first plurality of apertures are offset by a first pitch, and wherein adjacent apertures of the second plurality of apertures are offset by a second pitch. In some embodiments, the first pitch is different from the second pitch. For example, the first pitch may be larger than the second pitch. By way of another example, the first pitch may be smaller than the second pitch. In various embodiments, two apertures of the first plurality of apertures are positioned closer to each other than the first pitch so that the first pitch is distinct from the second pitch. In some embodiments, a number of apertures of the first plurality of apertures is different from a number of apertures of the second plurality of apertures. In other embodiments, a number of apertures of the first plurality of apertures is equal to a number of apertures of the second plurality of apertures.

In some embodiments, where the sharpening devices includes multiple sharpening stones, the sharpening device further comprises a second holder having a second recess configured to receive a second sharpening stone, a second coupler extending between the second holder and the base such that the second holder is rotatable relative to the base, wherein a geared surface of the second holder corresponds to a geared surface of the holder. In some example embodiments, the angle of the second sharpening stone is equal and opposite the angle of the sharpening stone relative to said definable vertical plane. In other example embodiments, the angle of the sharpening stone and the angle of the second sharpening stone are different relative to said definable vertical plane. In various embodiments, the second holder has a third plurality of apertures and the base has a fourth plurality of apertures, wherein the third plurality of apertures are arranged in a third definable circle having a third radius, wherein the fourth plurality of apertures are arranged in a fourth definable circle having a fourth radius, wherein the third radius is equal to the fourth radius, and wherein an aperture of the third plurality of apertures and an aperture of the fourth plurality of apertures are alignable to receive a setting device when setting an angle of the second sharpening stone relative to the definable vertical plane.

In some embodiments, adjacent apertures of said third plurality of apertures are offset by a third pitch, and wherein adjacent apertures of the fourth plurality of apertures are offset by a fourth pitch. In some embodiments, the third pitch is different from the fourth pitch. For example, the third pitch may be larger than the fourth pitch. By way of another example, the third pitch may be smaller than the fourth pitch. In various embodiments, two apertures of the third plurality of apertures are positioned closer to each other than the third pitch so that the third pitch is distinct from the fourth pitch. In some embodiments, a number of apertures of the third plurality of apertures is different from a number of apertures of the fourth plurality of apertures. In other embodiments, a number of apertures of the third plurality of apertures is equal to a number of apertures of the fourth plurality of apertures.

In various embodiments, the sharpening device further comprises a rod that extends at least partially in a lateral direction (e.g., including, but not limited to, an outward and/or upward direction) to protect the hands of a user. In some embodiments, the sharpening device further comprises a gauge plate connected to the base, wherein the gauge plate has indicia that identifies the angle of the sharpening stone relative to a vertical plane.

Another particular embodiment of the present disclosure is a method of adjusting the sharpening angle of a sharpening device comprising (i) providing a base having a first plurality of apertures extending through a portion of the base, and apertures of the first plurality of apertures are arranged on a first circle having a first radius, and at least some of the apertures of the first plurality of apertures are offset from each other by a first pitch; (ii) rotating a holder within the base, wherein the holder has a second plurality of apertures extending into a portion of the holder, wherein apertures of the of the second plurality of apertures are arranged on a second circle having a second radius, and at least some of the apertures of the second plurality of apertures are offset from each other by a second pitch, wherein the first radius is equal to the second radius, and the first pitch is distinct from the second pitch; and (iii) extending a setting device through one aperture of the first plurality of apertures and through one aperture of the second plurality of apertures to set the angle of a sharpening stone positioned in the holder.

A further particular embodiment of the present disclosure is a sharpening device for adjusting a first sharpening stone and a second sharpening stone, including a base having a plurality of base apertures extending through a portion of the base; a first holder having a first recess configured to receive a first sharpening stone, wherein the first holder has a plurality of first apertures extending into the first holder, and the first holder is rotatably disposed within the base such that a first aperture of the plurality of first apertures is selectively alignable with a first base aperture of the plurality of base apertures when said first sharpening stone and said second sharpening stone are at a first angle; a second holder having a second recess configured to receive a second sharpening stone, wherein the second holder has a plurality of second apertures extending into the second holder, and the second holder is rotatably disposed within the base such that a second aperture of the plurality of second apertures is selectively alignable with a second base aperture of the plurality of base apertures when said first sharpening stone and said second sharpening stone are at a second angle; and a first geared surface of the first holder configured to engage with a second geared surface of the second holder, wherein rotation of the first holder in one direction relative to the base causes rotation of the second holder in an opposing direction relative to the base when the first geared surface is engaged with the second geared surface.

In some embodiments, the plurality of first apertures are arranged in a first definable circle having a first radius, wherein adjacent apertures of the plurality of first apertures are offset by a first pitch; wherein the plurality of base apertures are arranged in a second definable circle having a second radius, and at least some of the base apertures of the plurality of base apertures are offset by a second pitch, wherein the first radius is equal to the second radius, wherein the first pitch is distinct from the second pitch, and wherein a first aperture and a base aperture are aligned to receive a setting device when said first sharpening stone and said second sharpening stone are at said first angle.

In some embodiments, the sharpening device further comprises a detent positionable in a first aperture of said plurality of first apertures, wherein a lip of said detent holds said detent within said first aperture; and a bias member positioned against a rear surface of said detent and configured to bias said detent out of said first aperture, wherein said detent is configured to selectively deflect into a base aperture of said plurality of base apertures to establish an angle of said first holder relative to said base.

In various embodiments, the sharpening device further comprises a detent positionable in a base aperture of said plurality of base apertures, wherein a lip of said detent holds said detent within said base aperture; and a bias member positioned against a rear surface of said detent and configured to bias said detent out of said base aperture, wherein said detent is configured to selectively deflect into a first aperture of said plurality of first apertures to establish an angle of said first holder relative to said base. In some embodiments, said first geared surface is part of a geared portion that is selectively removable from a remaining portion of said first holder.

A further particular embodiment of the present disclosure is a sharpening device for adjusting angles of a first sharpening stone and a second sharpening stone, comprising a base having at least one aperture; a first holder having a first recess configured to receive a first sharpening stone, wherein the first holder has a first gear surface on a first lower portion positioned within the at least one aperture of the base, and the first holder is rotatably disposed within the base; and a second holder having a second recess configured to receive a second sharpening stone, wherein the second holder has a second gear surface on a second lower portion positioned within the at least one aperture of the base, and the second holder is rotatably disposed within the base, wherein the first geared surface of the first holder is engaged with the second geared surface of the second holder, and wherein rotation of the first holder in one direction relative to the base causes rotation of the second holder in an opposing direction relative to the base.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about" or "approximately" or "substantially." One skilled in the art will appreciate that these terms, for instance, can imply variation, on a relative basis, of less than 10%.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

The Summary is neither intended, nor should it be construed, as being representative of the full extent and scope of the present disclosure. Moreover, references made herein to "the present disclosure" or aspects thereof should be understood to mean certain embodiments of the present disclosure and should not necessarily be construed as limiting all embodiments to a particular description. The present disclosure is set forth in various levels of detail in the Summary as well as in the attached Drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the Drawings.

Any one or more aspects described herein can be combined with any other one or more aspects described herein. Any one or more features described herein can be combined with any other one or more features described herein. Any one or more embodiments described herein can be combined with any other one or more embodiments described herein.

BRIEF DESCRIPTION OF THE DRAWINGS

The accompanying Drawings, which are incorporated herein and constitute a part of the specification, illustrate embodiments of the disclosure and together with the Summary given above and the Detailed Description given below serve to explain the principles of these embodiments. In certain instances, details that are not necessary for an understanding of the disclosure or that render other details difficult to perceive may have been omitted. It should be understood, of course, that the present disclosure is not necessarily limited to the particular embodiments illustrated herein. Additionally, it should be understood that the Drawings are not necessarily to scale.

Figure 1A:
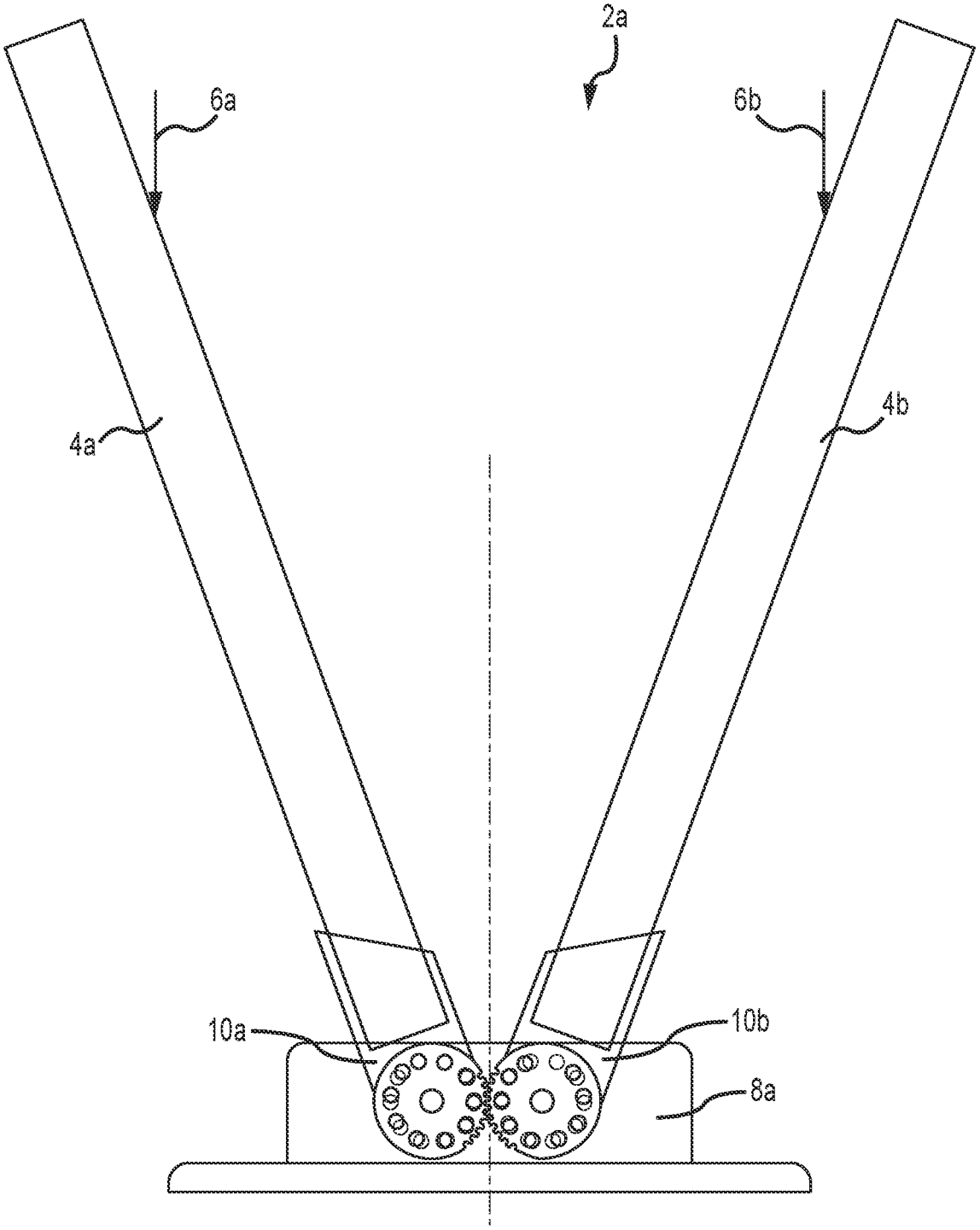
FIG. 1A is a front elevation view of sharpening stones in first and second holders in a base of a sharpening device, according to embodiments of the present disclosure.

To assist in the understanding the present disclosure the following list of components and associated numbering found in the Drawings is provided herein:

| Number | Component |
|---|---|
| 2a, 2b, 2c, 2d | Sharpening Device |
| 4a, 4b | Sharpening Stone |
| 6a, 6b | Sharpening Direction |
| 8a, 8b, 8c, 8d | Base |
| 10a, 10b | Holder |
| 12 | Gauge Plate |
| 14a, 14b | Central Aperture |
| 16a, 16b | Plurality of Apertures |
| 18a, 18b | Radius |
| 20a, 20b | Pitch |
| 22a, 22b | Fastener Aperture |
| 23a, 23b | Safety Rod Aperture |
| 24 | Central Volume |
| 26a, 26b | Upper Portion |
| 28a, 28b | Lower Portion |
| 30a, 30b | Fastener Bore |
| 32a, 32b | Central Aperture |
| 34a, 34b | Plurality of Apertures |
| 36a, 36b | Gear Surface |
| 38a, 38b | Radius |
| 40a, 40b | Pitch |
| 42a, 42b | Stone Aperture |
| 44 | Fastener Aperture |
| 46a, 46b | Coupler |
| 48 | Aligned Aperture |
| 50 | Setting Device |
| 52 | Screw |
| 54 | Engagement Surface |
| 56 | Screw |
| 58 | Engagement Surface |
| 60a, 60b | Gauge Plate Sections |
| 62a, 62b | Interlocking Assembly |
| 64a, 64b | Coupler |
| 66a, 66b | Securing Component |
| 68a, 68b | View Hole |
| 70a, 70b | Angle Indicators |
| 72 | Angle Gauge |
| 73 | Exterior Surface |
| 74 | Pointer |
| 76 | Pointer Axle |
| 78 | Angle Indicator |
| 80 | Pointer Gear |

-continued

| Number | Component |
|---|---|
| 82a, 82b | Secondary Gears |
| 84 | Thumb Screw or Thumb Wheel |
| 86 | Base Stand |
| 88 | Safety Rods |
| 90a, 90b | Stand Portions |
| 92a, 92b | Mechanical Latch |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the attached Drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

FIGS. 1A-8 in general illustrate a sharpening device 2*a*, in accordance with one or more embodiments of the present disclosure. The sharpening device 2*a* is usable with a relatively low amount of skill and dexterity. The sharpening device 2*a* can be adjusted to provide a wide range of sharpening angles for use, allowing it to be adapted to the original angle of many different knives and tools.

Referring now to FIG. 1A, a front elevation view of the sharpening device 2*a* is provided. The sharpening device 2*a* holds and orients two opposing sharpening stones 4*a*, 4*b*. To sharpen an edge of a tool, such as a knife, the tool is held with the edge downward, then a first side of the edge of the tool is drawn along part of one sharpening stone 4*a* in the direction 6*a* shown. Next, a second side of the edge of the tool is drawn along part of the other sharpening stone 4*a* in the direction 6*b* shown. A user holding the edge of the tool against the sharpening stone 4*a*, 4*b* in a substantially vertical or downward direction such as shown for 6*a*, 6*b*, in combination with the ability to set the sharpening stones 4*a*, 4*b* at a particular desired angle, increases the ease of reproducing the correct sharpening motion for a particular tool edge as compared to known horizontal sharpening devices such as whetstones.

The sharpening stones 4*a*, 4*b* can have various sides with different roughness or grit such that they can be rotated to present a different roughness or grit for sharpening. In addition, the sharpening stones 4*a*, 4*b* can be substituted with other sharpening stones that have a different roughness, grit, or other characteristic for sharpening. As described herein, the orientation of the sharpening stones 4*a*, 4*b* can be adjusted relative to a base 8*a*. The fine control of the orientation of the sharpening stones, or sharpening angle, allows for the progressive sharpening of a single edge to a more acute angle, the sharpening of many different tools and edges requiring many different sharpening angles, among other uses. In one non-limiting example, sharpening on an edge of the stones 4*a*, 4*b* provides a coarser sharpening grit, and sharpening on a flat of the stones 4*a*, 4*b* provides a finer sharpening grit. Adjusting the stones 4*a*, 4*b* to sharpen on the edge and then the flat (and optionally changing stones and again sharpening on the edge of the flat) allows for the progressive sharpening of the edge.

The lower ends of the sharpening stones 4*a*, 4*b* each reside in a respective holder 10*a*, 10*b*. In turn, each holder 10*a*, 10*b* is disposed within a base 8*a* such that the holders 10*a*, 10*b* are rotatable relative to the base 8*a* about an axis through the holders 10*a*, 10*b* to change the sharpening angle of the sharpening stones 4*a*, 4*b*.

Each holder 10*a*, 10*b* has a plurality of apertures, and the base 8*a* has corresponding pluralities of apertures. The arrangement and interrelation between these apertures allows for a much finer and more precise control of the angle of the sharpening stones 4*a*, 4*b* as described herein. Specifically, the pitch between apertures on the base 8*a* is distinct from the pitch between apertures in the holders 10*a*, 10*b* such that different apertures between the base 8*a* and holders 10*a*, 10*b* are aligned to receive a setting device at different orientations of the holders 10*a*, 10*b* relative to the base 8*a*. It is noted pitch is defined in the present disclosure as a central angle between adjacent apertures in each set of apertures (or an angle whose apex or vertex is the respective center point of the definable circle having a select radius measured between the center point of the definable circle and a center point of each aperture, where the center of each adjacent aperture is located on the definable circle at a distance equal to the select radius). Examples of pitch are illustrated in FIG. 2 for the base 8*a*, and in FIGS. 4A and 5A for the holders 10*a*, 10*b* respectively, as described in detail further herein.

Figure 1B:
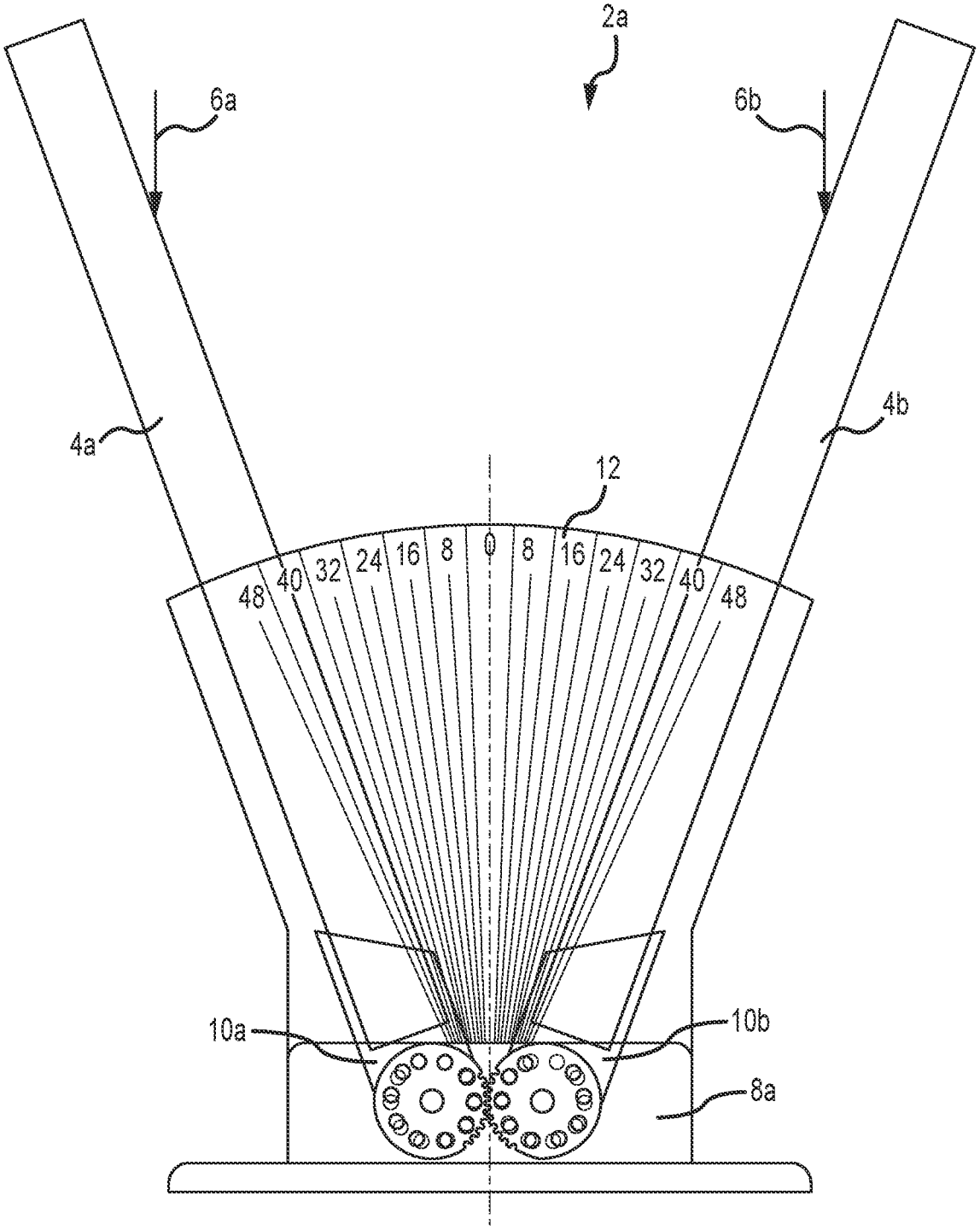
FIG. 1B is a front elevation view of a gauge plate and the sharpening device in FIG. 1A.

Referring now to FIG. 1B, in some embodiments a gauge plate 12 is connected to the base 8*a*. The gauge plate 12 has indicia to show the sharpening angles of the sharpening stones 4*a*, 4*b* relative to a definable vertical plane centered between the sharpening stones 4*a*, 4*b*. In one illustrative example, the sharpening stones 4*a*, 4*b* in FIG. 1B are set to 40 degrees, with several other orientation possibilities also shown on the gauge plate 12. It will be appreciated that these specific angles are exemplary in nature, and the present disclosure encompasses any sharpening angle or set of sharpening angles. In general, the indicia may range from any set of angles between 0 degrees and 180 degrees, in any increment of value (e.g., 1 degree, 2 degrees, 5 degrees, or the like). It is noted the indicia of the gauge plate 12 may correspond to the angle of the sharpening stone 4*a*, the angle of the sharpening stone 4*b*, or a combination of the two angles. For example, the gauge plate 12 may be dimensioned to correspond to the angle of the sharpening stone 4*a*, the angle of the sharpening stone 4*b*, or a combination of the two angles.

Figure 2:
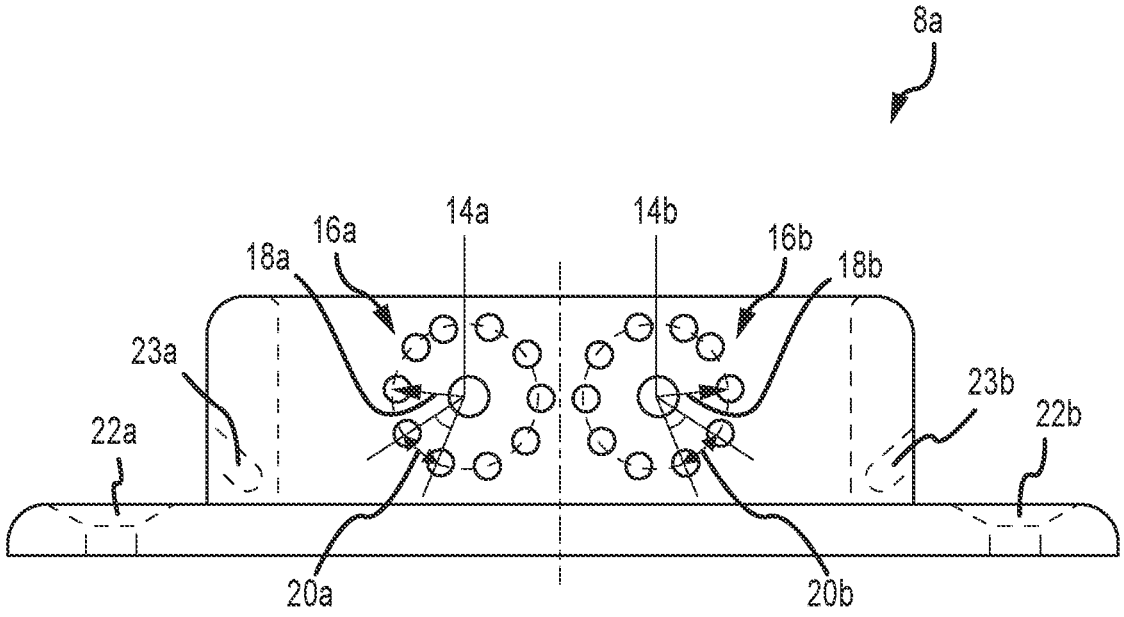
FIG. 2 is a front elevation view of a base of the sharpening device in FIG. 1A.

Referring now to FIG. 2, a front elevation view of the base 8*a* is provided. The base 8*a* has a first central aperture 14*a* that receives a coupler 46*a* about which the holder 10*a* rotates, and the base 8*a* has a second central aperture 14*b* that receives a coupler 46*b* about which the holder 10*b* rotates. In some embodiments, the axis of rotation for the holders 10*a*, 10*b* is co-axial with a central axis through the respective couplers 46*a*, 46*b*. In some embodiments of the present disclosure, a gasket or other space-filling device is inserted between the holders 10*a*, 10*b* and a respective inner surface of the base 8*a*, to assist in preventing movement of the holders 10*a*, 10*b* along the axis of rotation within the base 8*a* and/or to at least partially seal the base 8*a*.

The base 8*a* also has a first plurality of apertures 16*a* that corresponds to one holder and a second plurality of apertures 16*b* that corresponds to another holder. The apertures for the first plurality of apertures 16*a* are located on a circle centered on the first central aperture 14*a*, where the circle has a radius 18*a* as measured from the center of the first central aperture 14*a* to a center of an aperture of the first plurality of apertures 16*a*. Next, at least some of the apertures of the first plurality of apertures 16*a* are offset from each other along the circle by a pitch 20*a* measured from the centers of adjacent apertures. It will be appreciated that in some embodiments not all apertures adhere to this pitch 20*a*. Moreover, while the second plurality of apertures 16*b* exhibits bilateral symmetry and common radii 18*a*, 18*b* and pitches 20*a*, 20*b*, it will be appreciated that the present disclosure encompasses embodiments where the pluralities of apertures 16*a*, 16*b* have different characteristics such as radii 18*a*, 18*b* and pitches 20*a*, 20*b*. In this sense, a setting device 50 (e.g., a pin, screw, or other device operable to be inserted into the apertures 16*a*) can be used with the first plurality of apertures 16*a* to lock the sharpening stones 4*a*, 4*b* at a first series of angles, and then the setting device 50 can be used with the second plurality of apertures 16*b* to lock the sharpening stones 4*a*, 4*b* at a second, different series of angles.

Figure 3:
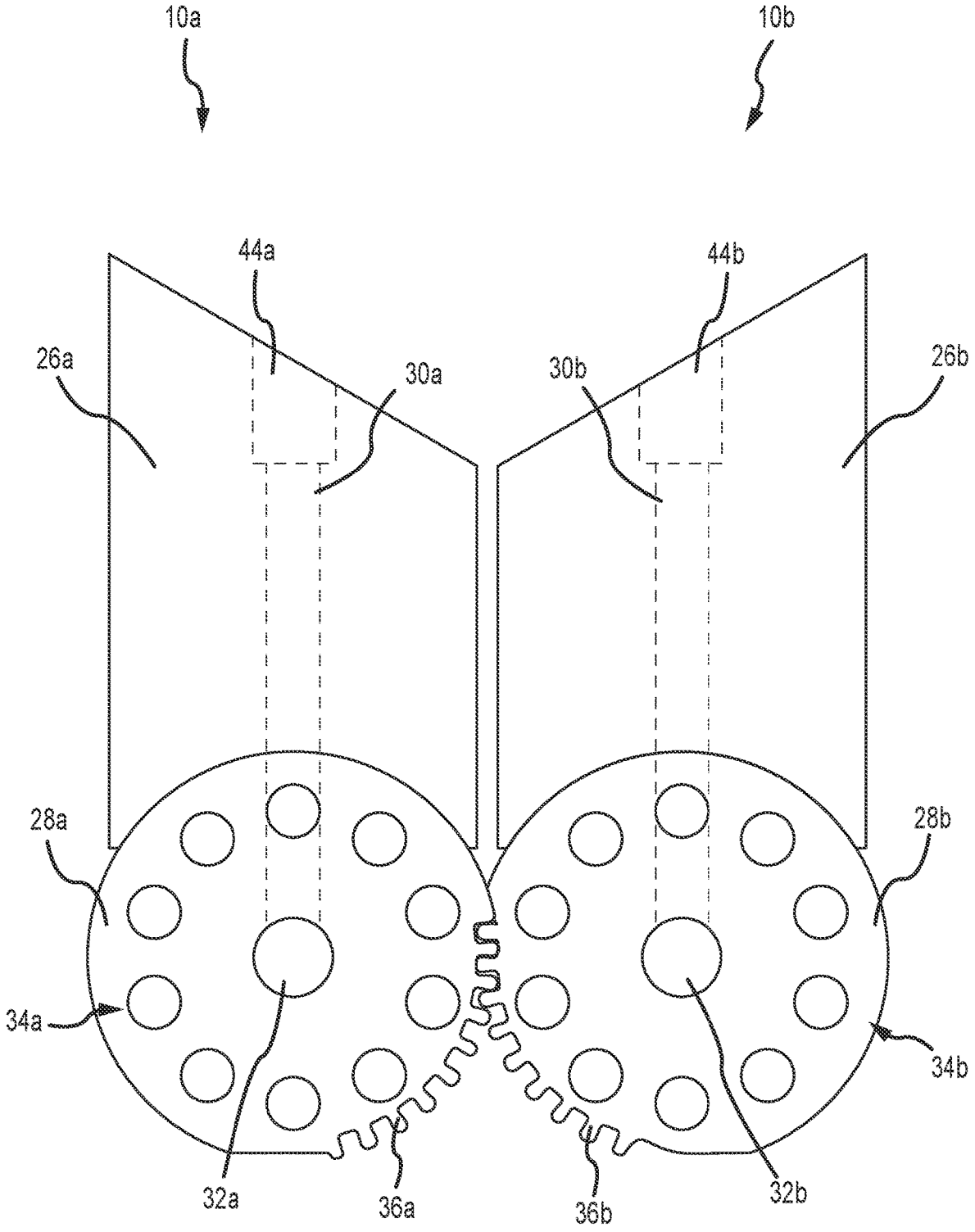
FIG. 3 is a front elevation view of a first holder and a second holder of the sharpening device in FIG. 1A.

Referring now to FIG. 3, a front elevation view of first and second holders 10*a*, 10*b* is provided. The first holder 10*a* generally comprises an upper portion 26*a* and a lower portion 28*a*, which can be joined together by a fastener passing through a fastener aperture 44*a* and into a fastener bore 30*a* that extends through the upper portion 26*a* and into the lower portion 28*a*. Moreover, the fastener can contact a coupler passing through a central aperture 32*a* of the lower portion 28*a* to join the portions 26*a*, 28*a* together with the coupler. The second holder 10*b* generally comprises an upper portion 26*b* and a lower portion 28*b*, which can be joined together by a fastener passing through a fastener aperture 44*b* and into a fastener bore 30*b* that extends through the upper portion 26*b* and into the lower portion 28*b*. Moreover, the fastener can contact a coupler passing through a central aperture 32*b* of the lower portion 28*b* to join the portions 26*b*, 28*b* together with the coupler. It will be appreciated that the present disclosure also encompasses embodiments where the holders 10*a*, 10*b* are each a single-piece fabricated component instead of being comprised of the upper portion 26*a*, 26*b* and the lower portion 28*a*, 28*b* respectively, such that the fastener is not required.

The first holder 10*a* has a plurality of apertures 34*a* and the second holder 10*b* has a plurality of apertures 34*b*, which are described in further detail herein. In addition, the first holder 10*a* has a geared surface 36*a* that corresponds to a geared surface 36*b* of the second holder 10*b*. When the holders 10*a*, 10*b* are positioned in the base 8*a* of the sharpening device 2*a*, the geared surfaces 36*a*, 36*b* ensure that the holders 10*a*, 10*b* maintain an opposing relationship. Therefore, in some embodiments, if the sharpening stone 4*a* of one holder 10*a* is oriented at a first angle relative to a vertical plane, the sharpening stone 4*b* of the other holder 10*b* is oriented at a second angle relative to the vertical plane that is opposite and equal to the first angle. It is noted, however, that the angle of the sharpening stone 4*a* in one holder 10*a* relative to the vertical plane may be different from the angle of the sharpening stone 4*b* in the other holder 10*b* relative to the vertical plane, without departing from the scope of the present disclosure. For example, will be appreciated that the present disclosure encompasses embodiments where the first angle is offset from the second angle by a predetermined angle, for example, 5 degrees. Thus, one stone of one holder could be used for one sharpening angle, and the stone of the other holder could be used for another sharpening angle. As shown in FIG. 3, in some embodiments the second holder 10*b* has a similar construction to the first holder 10*a* with the exception of the second gear surface 36*b* which complements the first gear surface 36*a* of the first holder 10*a*.

It will be appreciated that the present disclosure encompasses embodiments without geared surfaces 36*a*, 36*b*. In some embodiments, each holder 10*a*, 10*b* does not have a geared surface, and therefore, as one holder 10*a* rotates relative to the base 8*a*, the other holder 10*b* does not rotate. In these embodiments, a first setting device can lock the first holder 10*a* in place, and a second setting device can lock a second holder 10*b* in place, such that the first holder 10*a* and the second holder 10*b* may be set at the same angle or at different angles. Further still, the geared surfaces can be components that are selectively secured to or removed from each holder 10*a*, 10*b* to provide a user with the option of having the holders 10*a*, 10*b* move together or separately.

In alternative embodiments, the holders 10*a*, 10*b* are operably connected via a belt or chain where rotation of one holder 10*a*, 10*b* causes the other holder 10*b* to rotate in kind. Further still, instead of a geared surface, the holders 10*a*, 10*b* can have friction surfaces where rotation of one holder 10*a*, 10*b* causes the other holder 10*b* to rotate in kind. In some embodiments, the friction surface is a rubber or elastomeric surface that partially deforms when in contact with the other friction surface. This causes a friction force between the surface that is not overcome by rotation of one holder 10*a*, 10*b*.

Figure 4A:
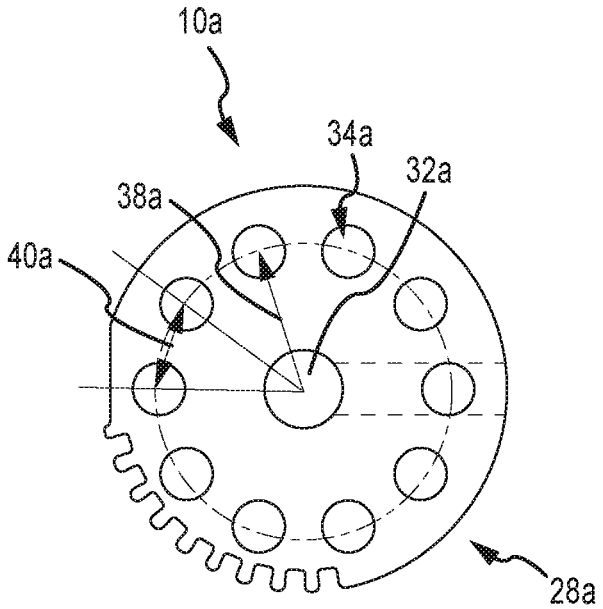
FIG. 4A is a front elevation view of a lower portion of the first holder in FIG. 3.
Figure 4B:
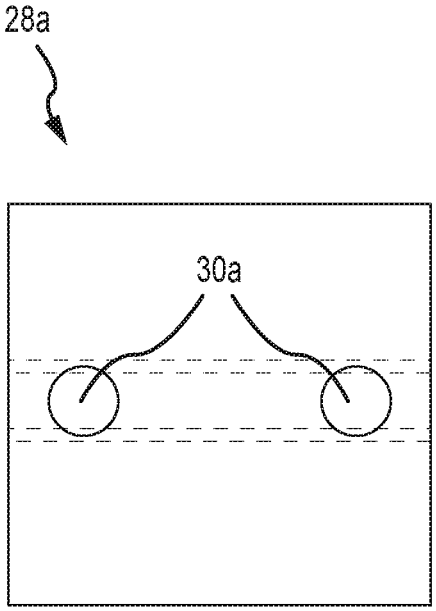
FIG. 4B is a top plan view of the lower portion of the first holder in FIG. 4A.

Referring now to FIGS. 4A and 4B, a front elevation view and a top plan view of the lower portion 28*a* of the first holder 10*a* is provided, respectively. In this embodiment, the lower portion 28*a* has a plurality of apertures 34*a* that extend through the lower portion 28*a*. The apertures of the plurality of apertures 34*a* are located on a circle centered on the first central aperture 32*a*, where the circle has a radius 38*a* as measured from the center of the first central aperture 32*a* to a center of an aperture of the first plurality of apertures 34*a*. Next, at least some of the apertures of the first plurality of apertures 34*a* are offset from each other along the circle by a pitch 40*a* measured from the centers of adjacent apertures. It will be appreciated that in some embodiments not all apertures adhere to this pitch 40*a*, meaning the pitch 40*a* can change vary between various apertures 34*a*.

The radius 38*a* of the lower portion 28*a* is equal to the radius 18*a* shown in FIG. 2, but the pitch 40*a* of the lower portion 28*a* is less than the pitch 20*a* shown in FIG. 2. In some embodiments, as illustrated in a comparison between FIGS. 2 and 4A, the difference in pitch is accomplished by the lower portion 28*a* having ten apertures 34*a* evenly arrayed around the central aperture 32*a* in FIG. 4A, whereas the base 8*a* of FIG. 2 has ten apertures 16*a* evenly arrayed around the central aperture 14*a* with the exception of two adjacent apertures 16*a*, which have a smaller distance therebetween compared to the remaining pitches 20*a* between apertures 16*a*. This difference in pitch can be accomplished in other ways. For example, the base can have nine evenly-arrayed apertures, and the lower portion 28*a* of the holder can have ten evenly-arrayed apertures. Moreover, the pitch between apertures of the lower portion 28*a* of the holder may be larger than the pitch between aperture of the base in some embodiments. In addition, it will be appreciated that the apertures 16*a* in the base 8*a* and/or the apertures 34*a* in the lower portion 28*a* (and similarly the apertures 16*b* in the base 8*a* and/or the apertures 34*b* in the lower portion 28*b*) may not be evenly arrayed such that the respective sets of apertures do not have the same pitch, without departing from the scope of the present disclosure. Regardless of how the difference in pitch is accomplished, the pitch between at least some apertures of the base is different than the pitch between at least some of the apertures of the lower portion of the holder in various embodiments. FIG. 4B shows that the lower portion 28*a* of the first holder can have two fastener bores 30*a* designed to receive fasteners to attach the upper portion 26*a* to the lower portion 28*a*.

Where the base 8*a* and the holders 10*a*, 10*b* have a different number of respective apertures 16*a*, 16*b* and 34*a*, 34*b*, it is noted the embodiments illustrated in FIGS. 1A-8 may operate via a principle similar to a vernier scale. Referring again to the example described above, the nine apertures 16*a*, 16*b* in the base 8*a* line up with the corresponding ten apertures 34*a*, 34*b* in the holders 10*a*, 10*b* in a fractional configuration, as the pitch between the ten apertures 34*a*, 34*b* is less than the pitch between the nine apertures 16*a*, 16*b*. As the pitches differ, the adjacent apertures 16*a*, 16*b* do not line up with adjacent apertures 34*a*, 34*b*; instead, each of the apertures 16*a*, 16*b* align with a non-adjacent respective aperture 34*a*, 34*b* at different rotation angles. In addition, the apertures 16*a*, 16*b* and the apertures 34*a*, 34*b* may incrementally align on one holder 10*a* and then another holder 10*b* in a sequential order, or instead align across both holders 10*a*, 10*b* via a step-like operation. For example, where the holders 10*a*, 10*b* align in a step-like operation, a first aperture 16*a* may align with a first aperture 34*a* on the first holder 10*a*, then a first aperture 16*b* may align with a first aperture 34*b* on the second holder 10*b*, then a second aperture 16*a* may align with a second aperture 34*a* on the first holder 10*a*, then a second aperture 16*b* may align with a second aperture 34*b* on the second holder 10*b*, and so on until some or all apertures 16*a*, 16*b* align with respective apertures 34*a*, 34*b*. It is noted this example is non-limiting with respect to the step-order (or back-and-forth) between the holders 10*a*, 10*b*. The combination of the step-like operation and the movement of the holders 10*a*, 10*b* being tied together via the geared surfaces 36*a*, 36*b* allows for the changing of the angle of the holders 10*a*, 10*b* in an incremental and fractional manner that is less than the respective pitches between the adjacent apertures 16*a*, 16*b* and apertures 34*a*, 34*b*. For example, the incremental and fractional manner may include any increment of value (e.g., 1 degree, 2 degrees, 5 degrees, or the like).

Figure 5A:
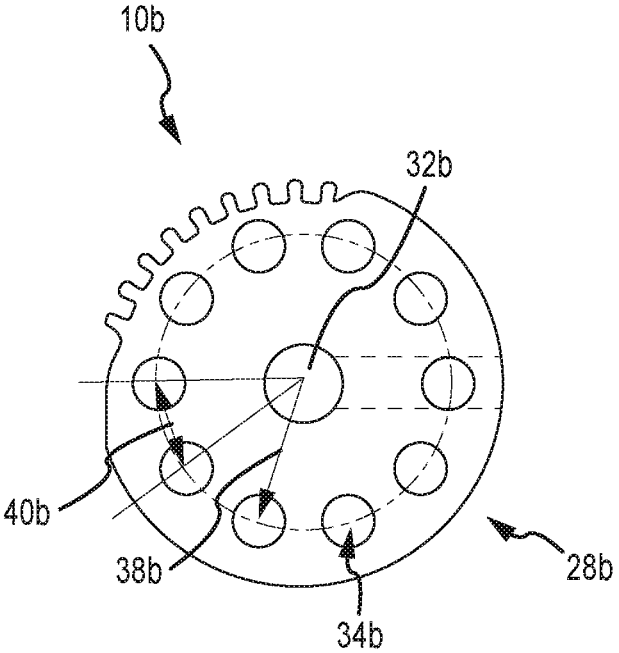
FIG. 5A is a front elevation view of a lower portion of the second holder in FIG. 3.
Figure 5B:
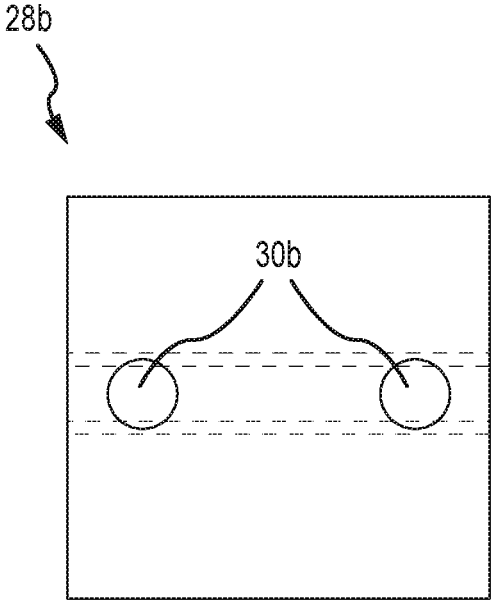
FIG. 5B is a top plan view of the lower portion of the second holder in FIG. 5A.

Referring now to FIGS. 5A and 5B, a front elevation view and a top plan view of the lower portion 28*b* of the second holder 10*b* are provided, respectively. This lower portion 28*b* has a plurality of apertures 34*b* that have the same arrangement with respect to the other plurality of apertures 16*b* of the base 8*a*, as the lower portion 28*a* of the first holder 10*a* with respect to the base 8*a*. Thus, this lower portion 28*b* has the plurality of apertures 34*b* having a radius 38*b* that is equal to the radius 18*b* shown in FIG. 2 and a pitch 40*b* that is less than the pitch 20*b* in FIG. 2. FIG. 5B shows that the lower portion 28*b* of the second holder can have two fastener bores 30*b* designed to receive fasteners to attach the upper portion 26*b* to the lower portion 28*b*.

Figure 6A:
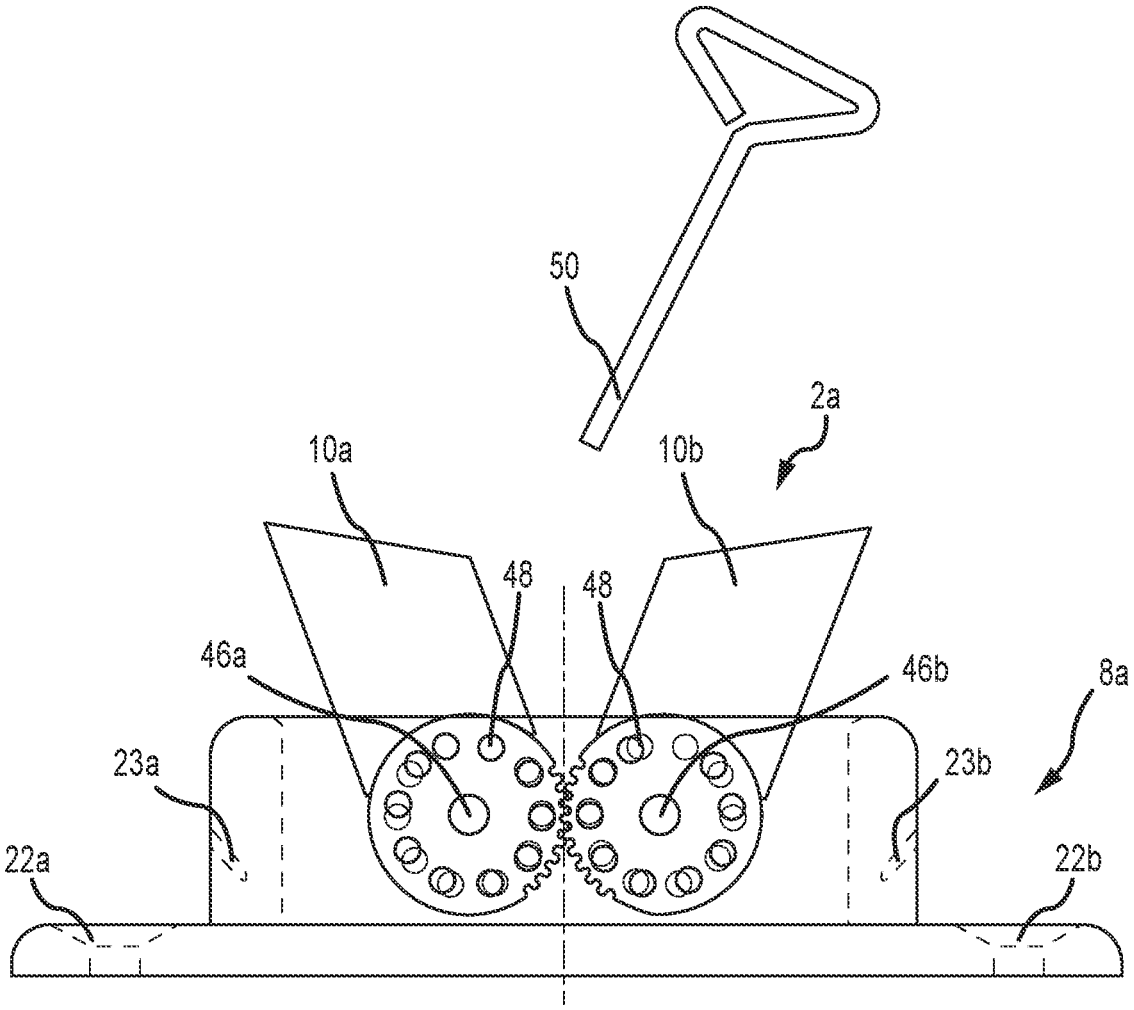
FIG. 6A is a front elevation view of first and second holders in a base of a sharpening device of FIG. 1A with a setting device, according to embodiments of the present disclosure.
Figure 6B:
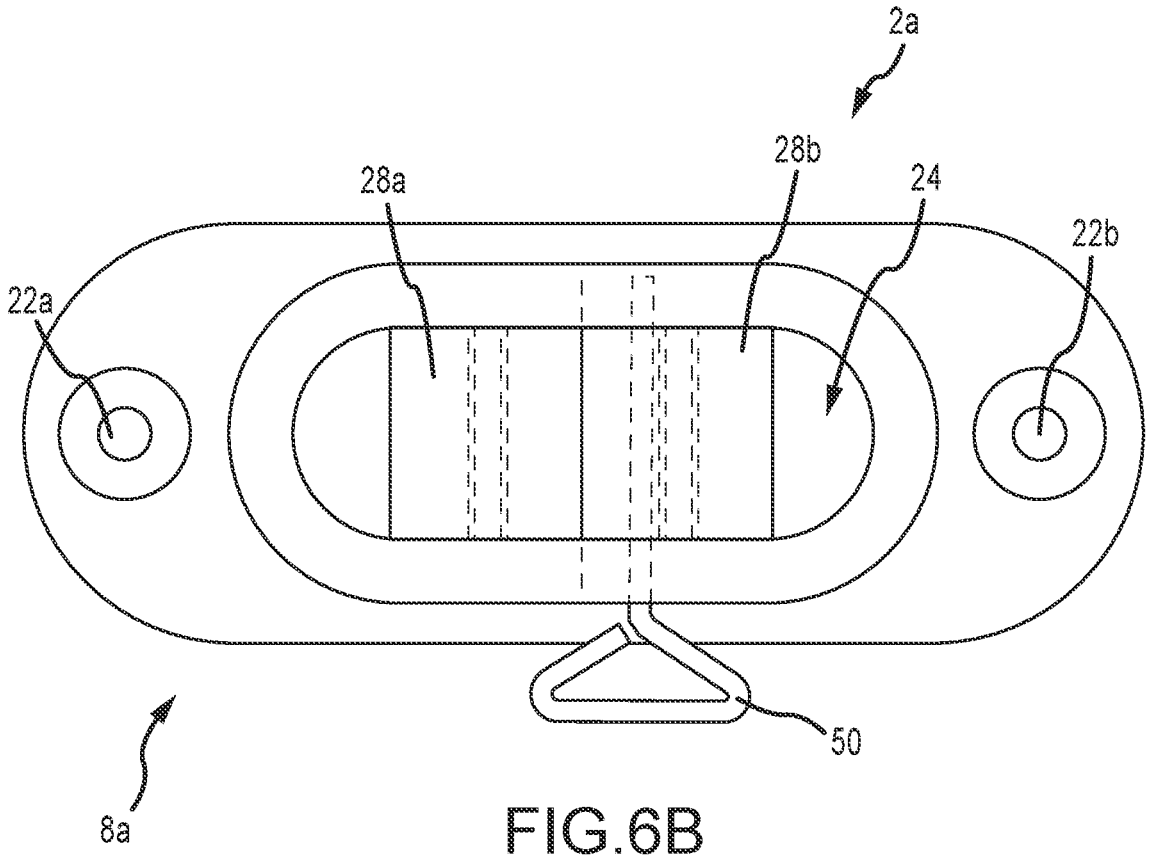
FIG. 6B is a top plan view of the sharpening device and the setting device of FIG. 6A.
Figure 6C:
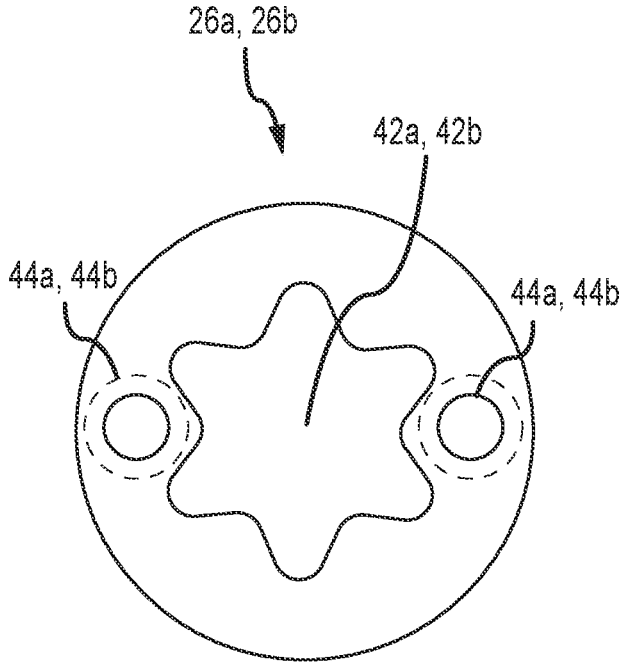
FIG. 6C is a top plan view of the first holder of FIG. 6A.

Referring now to FIGS. 6A-6C, a front elevation view and two top plan views of portions of a sharpening device 2*a* are provided, respectively.

Referring now to FIGS. 6A and 6B, each holder 10*a*, 10*b* is secured to the base 8*a* via a respective coupler 46*a*, 46*b* (e.g., a pin, axle, threaded or non-threaded fastener, or the like) that extends through the central apertures 14*a*, 14*b*, 32*a*, 32*b* described herein. It is noted, however, that the couplers 46*a*, 46*b* may be a biased component (e.g., spring-loaded, or the like) that is operable to be inserted into the respective apertures 32*a*, 32*b* of the holders 10*a*, 10*b*, with the assemblies 10*a*/46*a* inserted into the base 8*a* prior to the coupler 46*a* engaging the apertures 14*a* and/or with the assemblies 10*b*/46*b* being inserted into the base 8*a* prior to the coupler 46*b* engaging the apertures 14*b*. It is also noted that only the lower portions 28*a*, 28*b* of the respective holders 10*a*, 10*b* are illustrated in FIG. 6B, for purposes of clarity.

The apertures 34*a*, 34*b* are alignable with the apertures 16*a*, 16*b* when setting the angles of the sharpening stones 4*a*, 4*b*. In general, the coupler 46*a*, 46*b* may be an alignment device configured for defining and establishing concentricity of apertures in the base 8*a* and a respective holder 10*a*, 10*b*. As shown, the difference in pitch between the apertures in the holders 10*a*, 10*b* and the apertures in the base 8*a* causes all but one set of aligned apertures 48 per holder 10*a*, 10*b* to be misaligned. A setting device 50 is extended through one or both of the aligned apertures 48 to set the sharpening angle of sharpening stones in the holders 10*a*, 10*b*, where the aligned apertures 48 include an aligned set of apertures 16*a*, 34*a* or an aligned set of apertures 16*b*, 34*b*. For example, the setting device 50 may include a pin, a key, a threaded or non-threaded fastener, a mechanical detent, or other component usable as retention or locking mechanisms to prevent the rotation of the holders 10*a*, 10*b* relative to each other and within the base 8*a* once installed, inserted, or otherwise engaged. To change the sharpening angle, or angle that the sharpening stone forms with a vertical plane, the setting device 50 is removed from the aligned aperture 48, and the holders 10*a*, 10*b* are rotated such at a different aperture 34*a*, 34*b* of the holders 10*a*, 10*b* is aligned with a different aperture 16*a*, 16*b* of the base 8*a*, to form different aligned apertures 48. Then, the setting device 50 can be inserted in this newly aligned apertures 48 to set the new sharpening angle, thereby locking the holders 10*a*, 10*b*. The offset in pitch and other aspects as described herein allows for a more precise control of the sharpening angle of the stones.

In some embodiments, the setting device 50 shown in FIGS. 6A and 6B generally comprises a rod portion that is configured to extend through a portion of the base 8*a* and into one of the holders 10*a*, 10*b*. It is noted the setting device 50 may include a shaped portion (e.g., a hook, loop, or the like) with which a user may interact or engage, to assist in insertion and/or removal of the setting device 50 from the base 8*a* and the aperture 34*a* or 34*b* of the respective holder 10*a* or 10*b*. In some embodiments, the rod portion can extend through a portion of the base 8*a* (e.g., the front portion of the base 8*a*), through one of the holders 10*b*, and then through another portion of the base 8*a* (e.g., the rear portion of the base 8*a*). It is noted insertion of the setting device 50 into the base 8*a* and either of the holders 10*a*, 10*b* will lock both of the holders 10*a*, 10*b* at the desired sharpening angle between the sharpening stones 4*a*, 4*b* due to the meshing of the gear surfaces 36*a*, 36*b*. However, the multiple sets of apertures 34*a*, 34*b* configured to receive the setting device 50 allow for the sharpening device 2*a* to be configured for left-handed use or right-handed use.

In FIGS. 2, 6A, and 6B, fastener apertures 22*a*, 22*b* allow the base 8*a* to be firmly secured to a working surface (e.g., via pins, fasteners, or the like) to prevent unintentional movement of the sharpening device 2*a* during adjustment of the sharpening angle or use of the sharpening device. Various structures such as rods (e.g., safety rods 88) that extend over the expected position of the hands of a user can also be included in the sharpening device 2*a* to protect a user against contact with the knife or tool (e.g., via safety rod apertures 23*a*, 23*b*, as illustrated in FIG. 2). An interior surface of the base 8*a* defines a central volume 24 in the which the holders 10*a*, 10*b* are received and rotated.

Referring now to FIG. 6C, a top plan view of an upper portion 26*a* of the holder 10*a*. As shown in FIG. 6C, the upper portion 26*a* has a stone aperture 42*a* in which the sharpening stone 4*a* is disposed, and a fastener aperture 44*a* that leads to the fastener bore 30*a* (shown in FIG. 3). The shape of the stone aperture 42*a* can differ in various embodiments. In the embodiment shown, the stone aperture 42*a* has a six-pointed star shape designed to receive sharpening stones with a triangular cross-section in any of six different arrangements, such that any of three corners or any of three flat surfaces may be utilized during sharpening of an edge of a tool. The stone aperture 42*a* may accept a triangle stone or a cat-eye stone. It will be appreciated that in some embodiments the upper portion 26*b* of the holder 10*b* includes a stone aperture 42*b* and fastener apertures 44*b* that may be similar to or different from the stone aperture 42*a* as described, without departing from the scope of the present disclosure.

In some embodiments, the two upper portions 26*a*, 26*b* may be initially constructed together, and may then be separated along a line. It is noted FIG. 3 illustrates the upper portions 26*a*, 26*b* separated and attached to the respective lower portions 28*a*, 28*b* to form the holders 10*a*, 10*b*.

Figure 7:
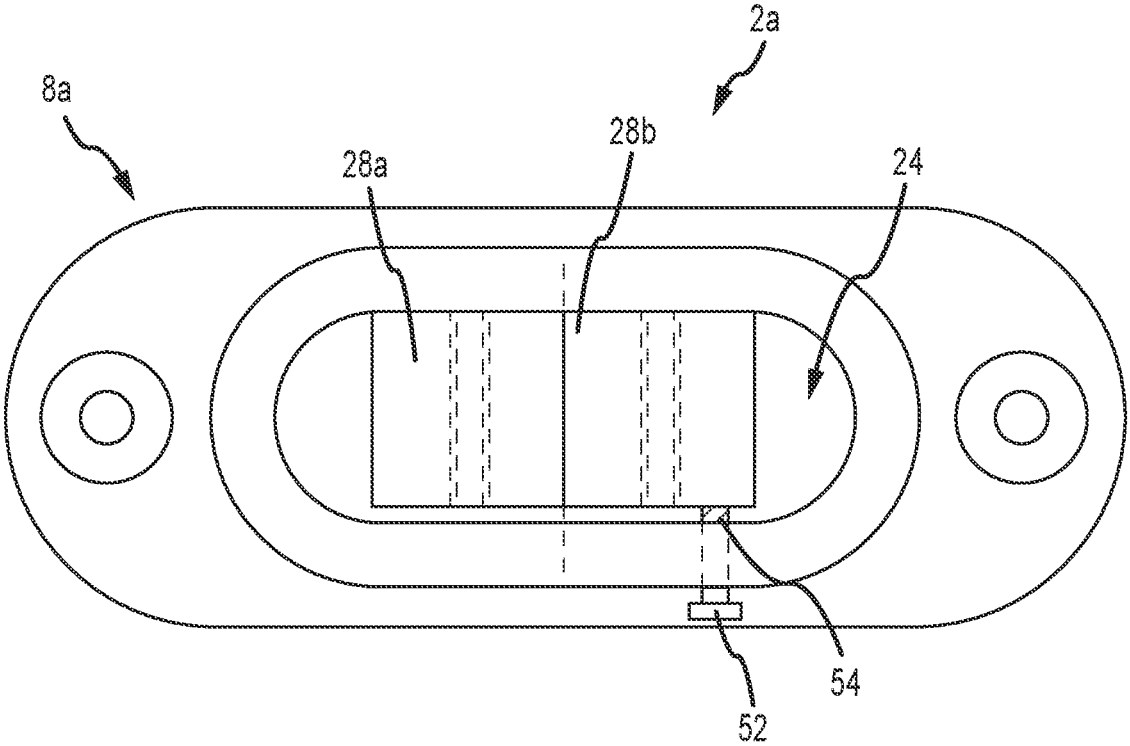
FIG. 7 is a top plan view of the sharpening device of FIG. 1A with one screw, according to embodiments of the present disclosure.

Referring now to FIG. 7, a top plan view of a sharpening device 2*a* is provided where the sharpening device 2*a* is adjustable to any angle rather than a finite number of discrete positions. With the embodiment in FIG. 7, the holders 10*a*, 10*b* are movable as described elsewhere herein, and a screw 52 (or other threaded fastener) is threadably engaged through an aperture of the base 8*a* and presses into the side of one of the holders 10*a*, 10*b* to fix or establish the position of the holders 10*a*, 10*b* at any angle. The screw 52 can have a flat end or engagement surface 54 (e.g., at a distal end of the screw 52) that presses against or into a planar surface of one of the holders 10*a*, 10*b*, and the resulting friction force fixes the holders 10*a*, 10*b* in place. Thus, a user can move the holders 10*a*, 10*b* to the desired angle (e.g., using the gauge plate 12), and then turn the screw 52 into one of the holders 10*a*, 10*b*. In various embodiments, the engagement surface 54 of the screw 52 can be a different shape or have a coating or portion that increases the friction force with the front surfaces of the holders 10*a*, 10*b*. While FIG. 7 shows a single screw 52, embodiments of the present disclosure can include more than one screw 52 to more securely set the position of the holders 10*a*, 10*b*, for example one screw 52 per holder 10*a*, 10*b* or two screws 52 for one holder 10*a*, 10*b*, etc. It is noted that only the lower portions 28*a*, 28*b* of the respective holders 10*a*, 10*b* are illustrated in FIG. 7, for purposes of clarity.

Figure 8:
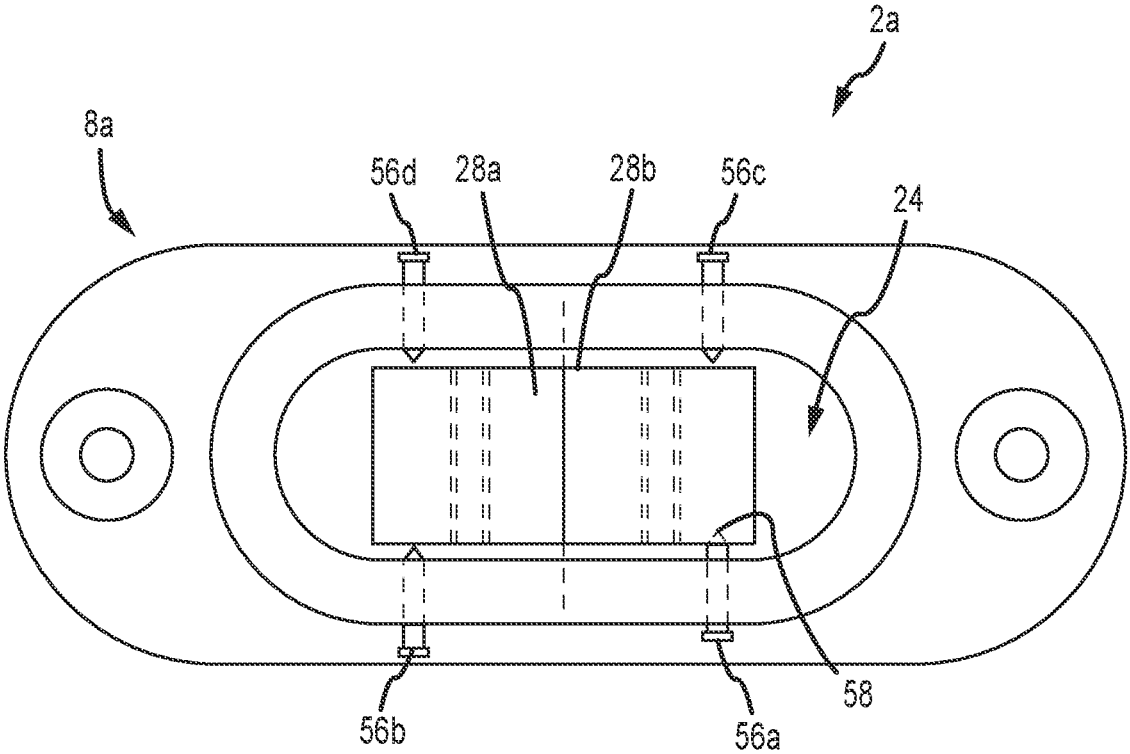
FIG. 8 is a top plan view of the sharpening device of FIG. 1A with a plurality of screws, according to embodiments of the present disclosure.

Referring now to FIG. 8, a top plan view of another sharpening device 2*a* is provided. This device 2*a* has screws 56*a*, 56*b*, 56*c*, 56*d* (or other threaded fastener), each with a non-flat end or engagement surface 58 (e.g., at a distal end of the screws 56*a*, 56*b*, 56*c*, 56*d*) that is configured to extend into one of the holders 10*a*, 10*b*, which have an arrangement of recesses or apertures as shown in FIGS. 4A and 5A. The four screws 56*a*, 56*b*, 56*c*, 56*d* are aligned with different recesses or apertures in a particular sequence to finely control the angle of the holders 10*a*, 10*b*. In one position, a first screw 56*a* is aligned with an aperture 34*b* on one side of one holder 10*b*. The holders 10*a*, 10*b* are moved, and then another screw 56*b* is aligned with an aperture 34*a* on one side of the other holder 10*a*. The holders 10*a*, 10*b* are moved further in the same direction, and then another screw 56*c* is aligned with an aperture 34*b* on an opposing side of one holder 10*b*. The holders 10*a*, 10*b* are moved further still, and then another screw 56*d* is aligned with an aperture 34*a* on an opposing side of the other holder 10*a*. If the holders 10*a*, 10*b* are rotated even further in the same direction, the first screw 56*a* can align with a new aperture 34*b* on one side of the holder 10*b*, and the cycle repeats. With this embodiment, the angle of the holders 10*a*, 10*b* can be precisely set with a fine resolution between positions such as 5 degrees, 2 degrees, or even 1 degree. Moreover, the screws 56*a*, 56*b*, 56*c*, 56*d* positively engage the holders 10*a*, 10*b* in a more secure engagement to prevent any inadvertent movement of the holders 10*a*, 10*b*, which can present safety issues during operation of the sharpening device 2*a*. It will be appreciated that other embodiments can include a greater or fewer number of screws 56*a*, 56*b*, 56*c*, 56*d* than what is shown in FIG. 8. In addition, the pattern of alignment and engagement between the screws 56*a*, 56*b*, 56*c*, 56*d* and the recesses or apertures in the holders 10*a*, 10*b* can follow a different sequence then the sequence described above. Further, it is noted that only the lower portions 28*a*, 28*b* of the respective holders 10*a*, 10*b* are illustrated in FIG. 8, for purposes of clarity.

FIGS. 9A-15 in general illustrate a sharpening device 2*b*, in accordance with one or more embodiments of the present disclosure. The sharpening device 2*b* is usable with a relatively low amount of skill and dexterity. The sharpening device 2*b* can be adjusted to provide a wide range of sharpening angles for use, allowing it to be adapted to the original angle of many different knives and tools. The sharpening device 2*b* has many features that are the same as, or similar to, the sharpening device 2*a*. Moreover, the sharpening device 2*b* may operate in a same or similar manner as the sharpening device 2*a*, aside from any differences as described herein.

Figure 9A:
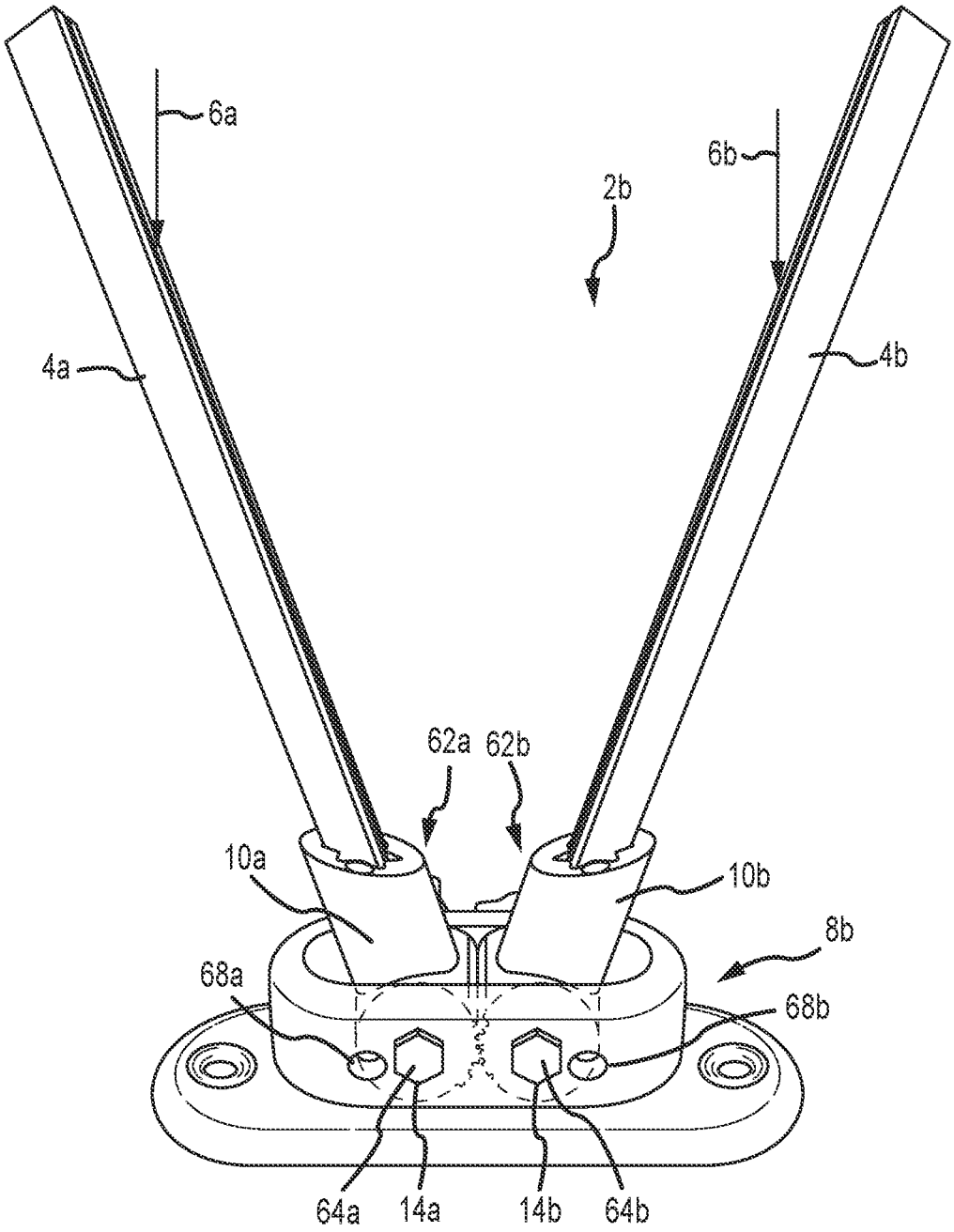
FIG. 9A is a front perspective view of sharpening stones in first and second holders in a base of a sharpening device, according to embodiments of the present disclosure.

Referring now to FIG. 9A, a base 8*b* of the sharpening device 2*b* is configured to receive the holders 10*a*, 10*b* for the sharpening stones 4*a*, 4*b* respectively. A user holding the edge of the tool against the sharpening stone 4*a*, 4*b* in a substantially vertical or downward direction such as shown for 6*a*, 6*b*, in combination with the ability to set the sharpening stones 4*a*, 4*b* at a particular desired angle, increases the ease of reproducing the correct sharpening motion for a particular tool edge as compared to known horizontal sharpening devices such as whetstones.

Figure 9B:
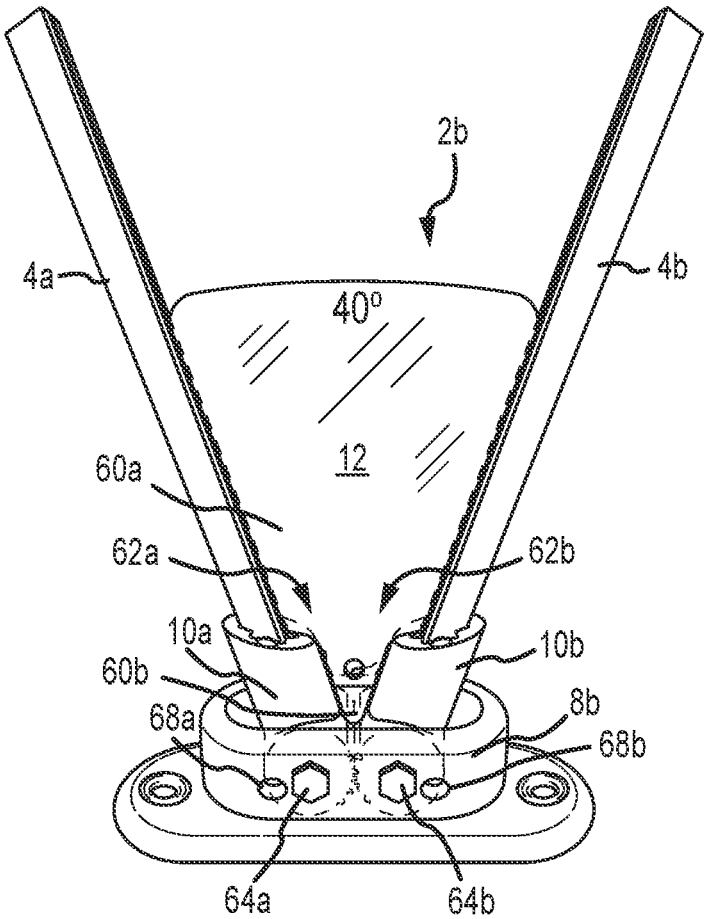
FIG. 9B is a front perspective view of the sharpening device of FIG. 9A and a gauge plate representing an angle of 40 degrees, according to embodiments of the present disclosure.
Figure 9C:
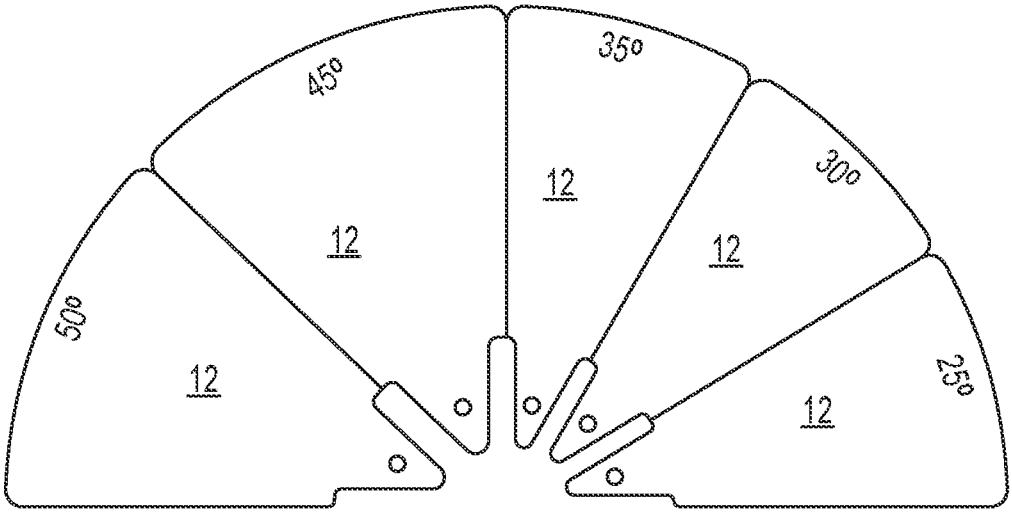
FIG. 9C is a front elevation view of gauge plates respectively representing 25-degree, 30-degree, 35-degree, 45-degree, and 50-degree angles, according to embodiments of the present disclosure.
Figure 10:
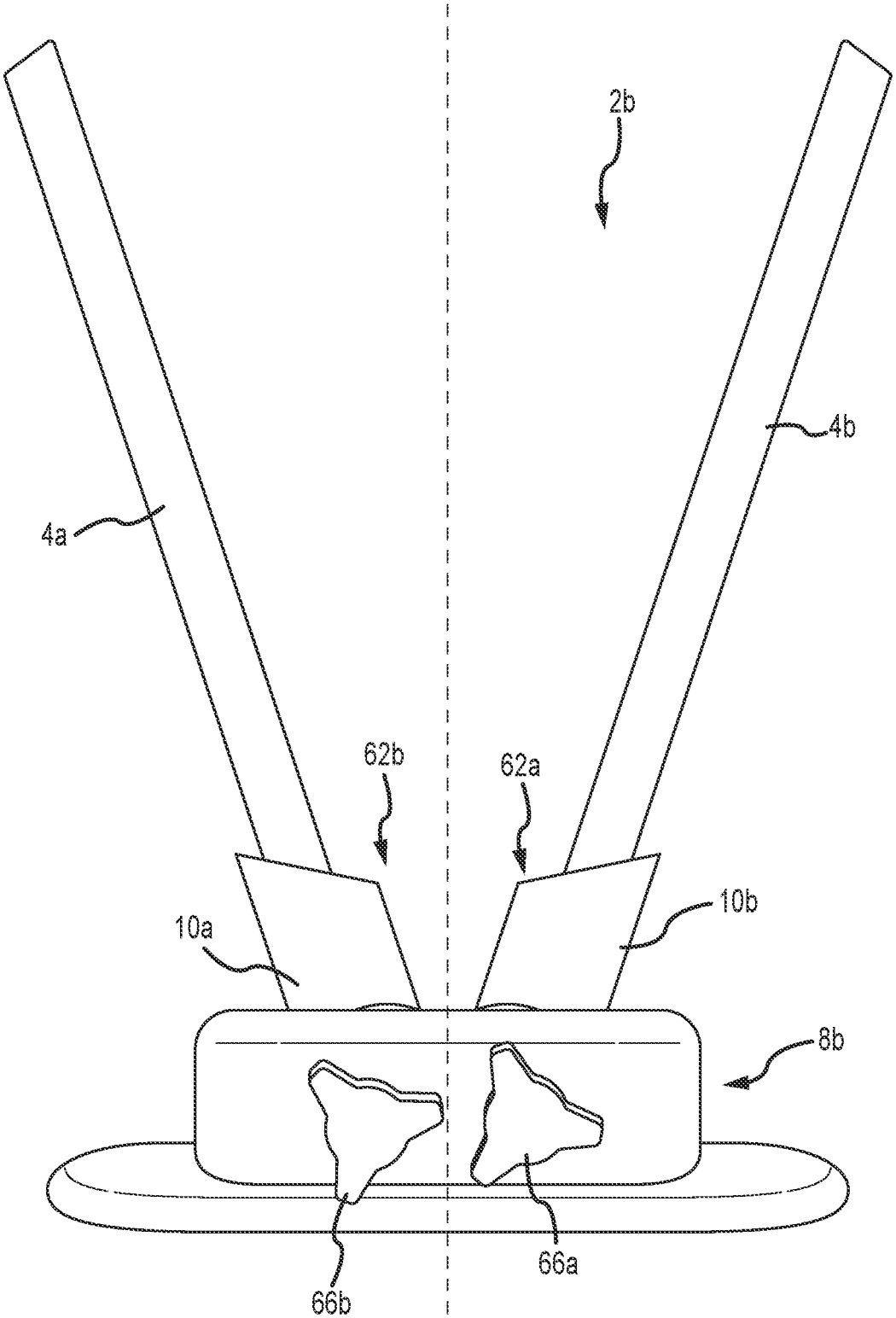
FIG. 10 is a rear elevation view of the sharpening device in FIG. 9A.
Figure 11:
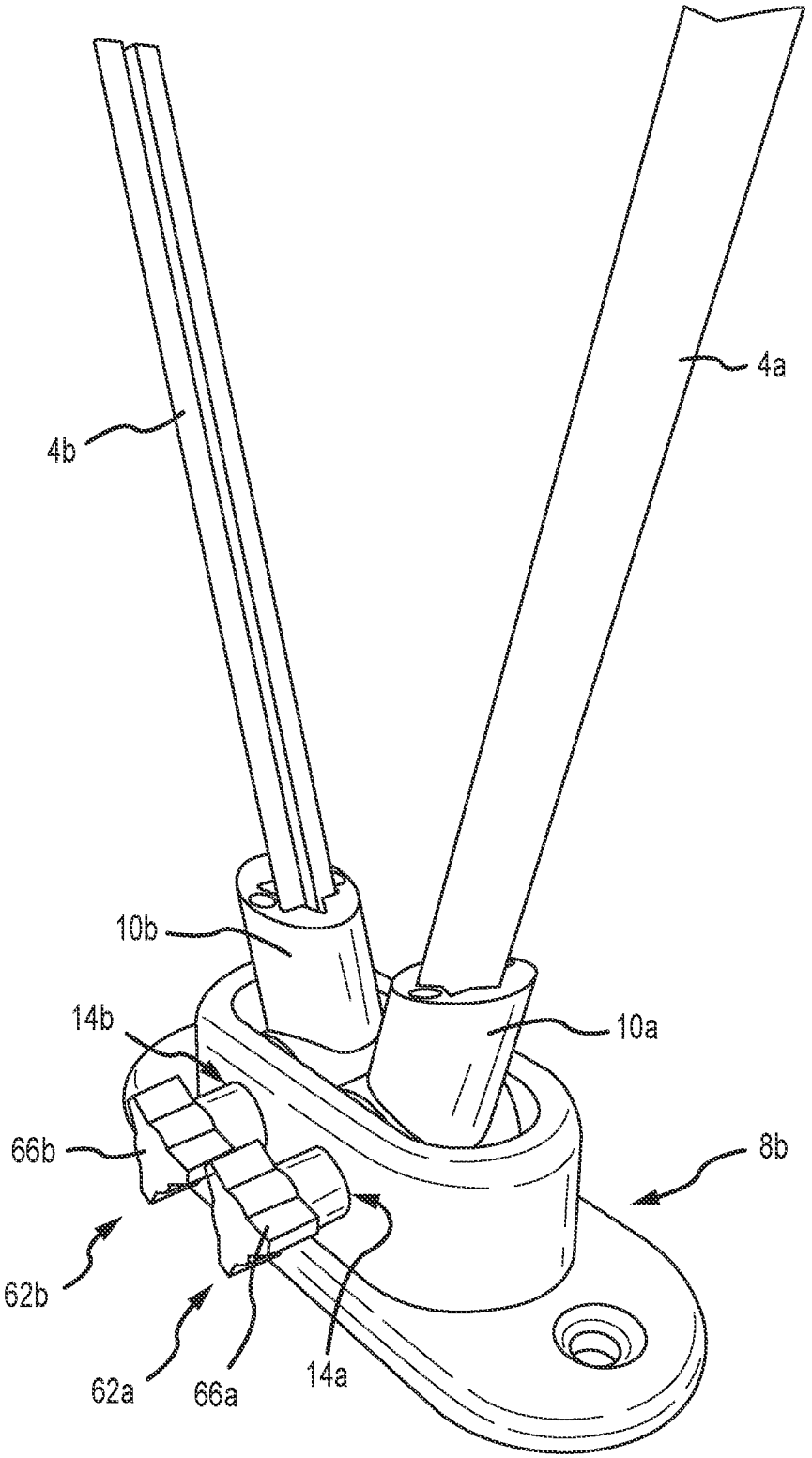
FIG. 11 is a rear left perspective view of the sharpening device in FIG. 9A.
Figure 12:
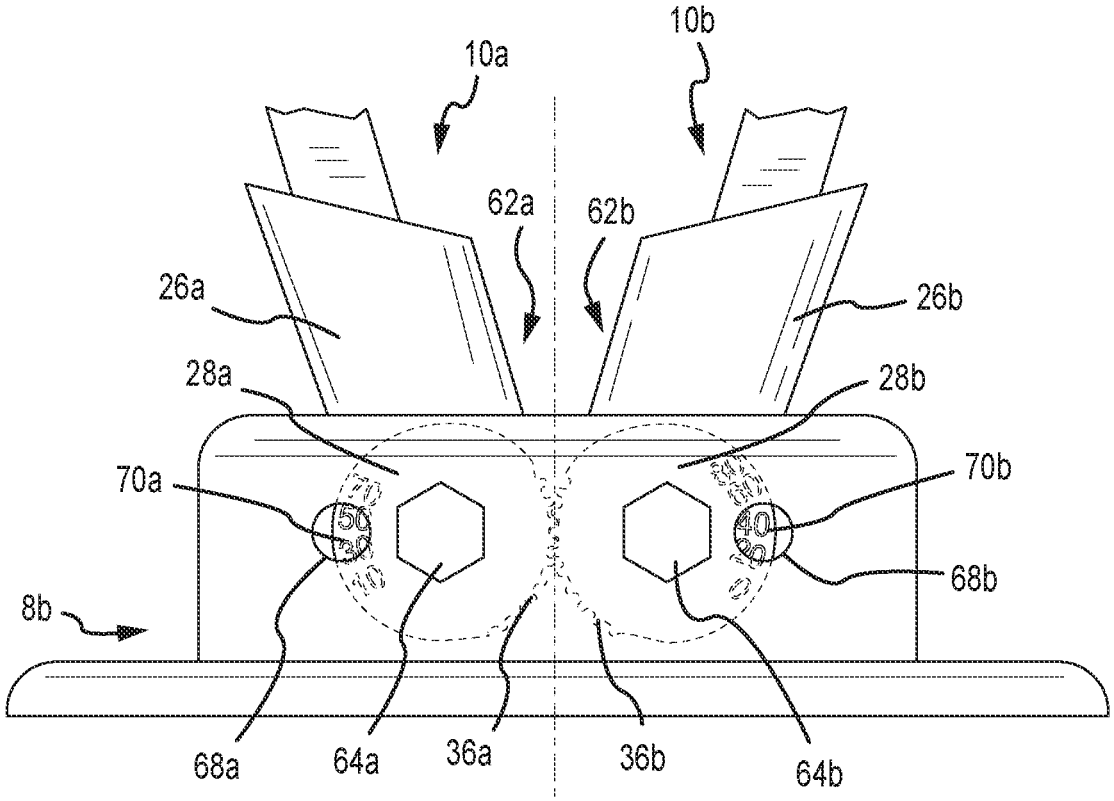
FIG. 12 is a front elevation view of portions of the sharpening device in FIG. 9A.
Figure 14:
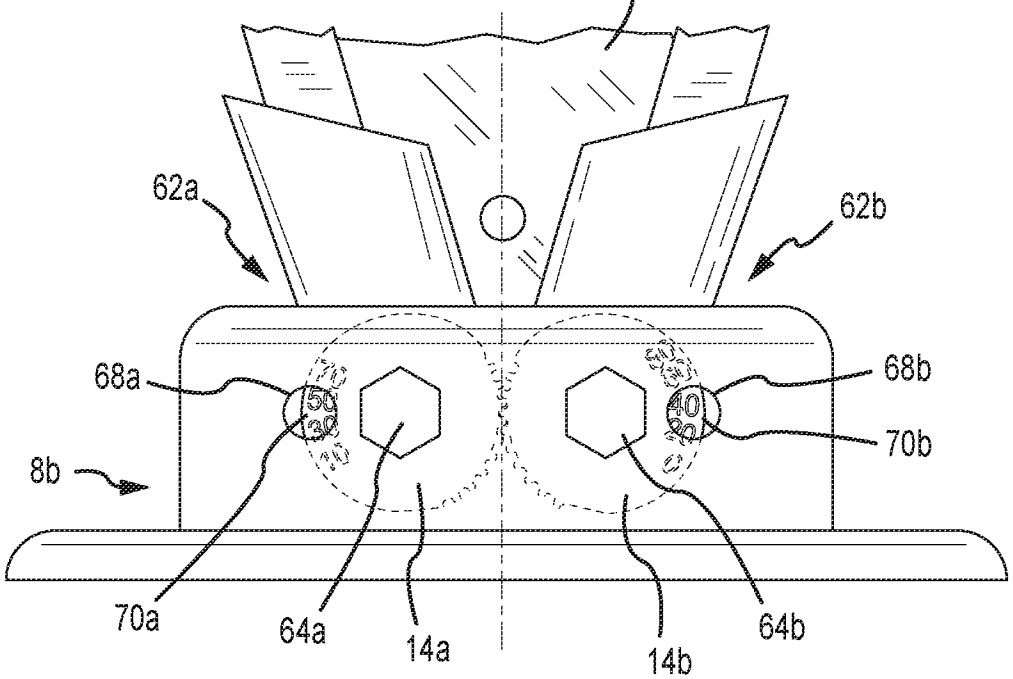
FIG. 14 is a front elevation view of portions of the sharpening device in FIG. 9A.
Figure 13:
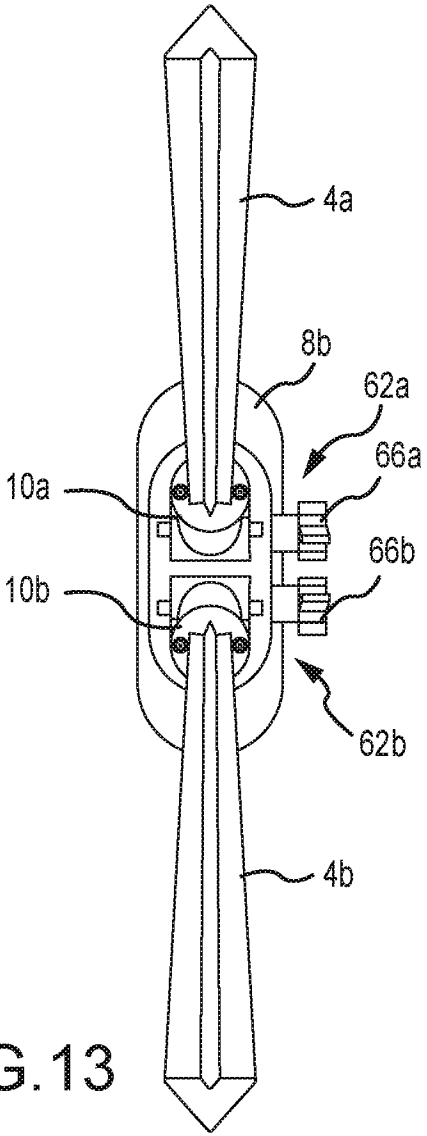
FIG. 13 is a top plan view of the sharpening device in FIG. 9A.
Figure 15:
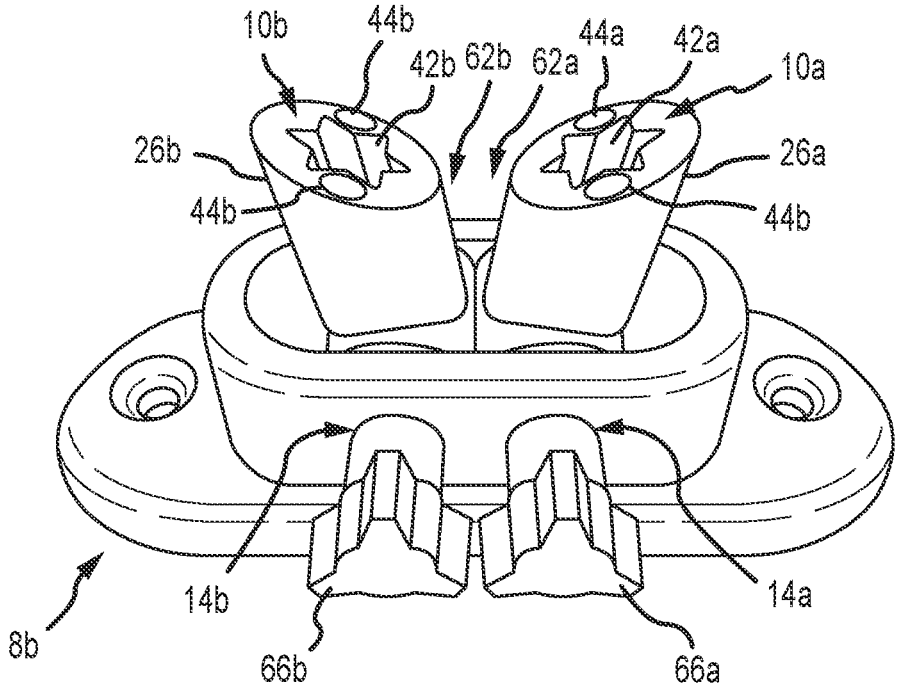
FIG. 15 is a rear top perspective view of the sharpening device in FIG. 9A.

Referring now to FIGS. 9B and 9C, the desired angle can be illustrated via gauge plates 12 provided with the sharpening device 2*b*. For example, FIG. 9B illustrates a gauge plate 12 that corresponds to a 40-degree angle between the sharpening stones 4*a*, 4*b*. In addition, FIG. 9C illustrates additional gauge plates 12 that correspond to 25-degree, 30-degree, 35-degree, 45-degree, and 50-degree angles, respectively. It is noted the angle of the gauge plate 12 may correspond to the angle of the sharpening stone 4*a*, the angle of the sharpening stone 4*b*, or a combination of the two angles.

In some embodiments, the gauge plates 12 may include gauge plate sections 60*a*, 60*b*. For example, the gauge plate section 60*a* may illustrate the angle between the sharpening stones 4*a*, 4*b*, and the gauge plate section 60*b* may illustrate the angle between the holders 10*a*, 10*b*. It will be appreciated, however, that the present disclosure encompasses embodiments in which the edges of the gauge plates 12 are continuous and without a transition portion, such that there is only a single section 60.

Referring again generally to FIGS. 9A-15, in some embodiments the base 8*b* is translucent or transparent (e.g., is at least partially see-through), and the holders 10*a*, 10*b* are visible through the see-through base 8*b*. For example, the meshing of the gear surfaces 36*a*, 36*b* of the lower portions 28*a*, 28*b* of the holders 10*a*, 10*b* respectively may be viewable through the base 8*b*. In this regard, the see-through base 8*b* may provide a visual aid that the gears are correctly meshing and keeping the sharpening stones 4*a*, 4*b* at the same and/or correct angle.

The holders 10*a*, 10*b* are held within the base 8*b* via corresponding interlocking assemblies 62*a*, 62*b*. The interlocking assemblies 62*a*, 62*b* may include a coupler 64*a*, 64*b* respectively (e.g., a pin, axle, threaded or non-threaded fastener, or the like) between the base 8*b* and the respective holders 10*a*, 10*b*. For example, the couplers 64*a*, 64*b* may be configured to enter through a first surface of the base 8*b*, pass through the holders 10*a*, 10*b*, and exit through a second surface of the base 8*b* (e.g., within apertures 14*a*, 14*b*). It is noted that apertures 14*a*, 14*b* may be similar shaped to a head of the couplers 64*a*, 64*b* (e.g., to prevent movement of the head within the base 8*b*) or may be different in shape, without departing from the scope of the present disclosure.

In some embodiments, the axis of rotation for the holders 10*a*, 10*b* is co-axial with a central axis through the respective couplers 64*a*, 64*b*. In some embodiments of the present disclosure, a gasket or other space-filling device is inserted between the holders 10*a*, 10*b* and a respective inner surface of the base 8*b*, to assist in preventing movement of the holders 10*a*, 10*b* along the axis of rotation within the base 8*b* and/or to at least partially seal the base 8*b*.

In general, the coupler 64*a*, 64*b* may be an alignment device configured for defining and establishing concentricity of apertures in the base 8*b* and a respective holder 10*a*, 10*b*. In some embodiments, the interlocking assemblies 62*a*, 62*b* may include a nut, knob, pin, or other securing component 66*a*, 66*b* couplable (e.g., attachable, connectable, or the like) to the respective couplers 64*a*, 64*b* within the base 8*b*. In some embodiments, the securing components 66*a*, 66*b* each have a first position where the holders 10*a*, 10*b* are able to rotate with or about an axis through the respective couplers 64*a*, 64*b*, and a second position where the holders 10*a*, 10*b* are not able to rotate with or about an axis throughout the respective couplers 64*a*, 64*b*. Although embodiments illustrate the interlocking assemblies 62*a*, 62*b* are removable from the base 8*b* (e.g., via the uncoupling of the securing components 66*a*, 66*b* from the respective couplers 64*a*, 64*b*, and then removal of the couplers 64*a*, 64*b* from the base 8*b*), it is noted the interlocking assemblies 62*a*, 62*b* may be a fixed as a riveted or machined assembly within the base 8*b*. In addition, it is noted each or either of the interlocking assemblies 62*a*, 62*b* may instead be a single fabricated component or constructed assembly. In one non-limiting example, the couplers 64*a*, 64*b* may be a biased component (e.g., spring-loaded, or the like) that is operable to be inserted into the respective apertures 32*a*, 32*b* of the holders 10*a*, 10*b*, with the assemblies 10*a*/64*a* inserted into the base 8*b* prior to the coupler 64*a* engaging the apertures 14*a* and/or with the assemblies 10*b*/64*b* being inserted into the base 8*b* prior to the coupler 64*b* engaging the apertures 14*b*.

The base 8*b* includes view holes 68*a*, 68*b* aligned with angle indicators 70*a*, 70*b* on the lower portions 28*a*, 28*b* of the holders 10*a*, 10*b*. For example, the angles indicator 70*a*, 70*b* may range between 0 degrees and 90 degrees. It is noted the angles indicators 70*a*, 70*b* are indicia that are individually alignable (e.g., an indicium is alignable) with a respective view hole 68*a*, 68*b* when setting the first angle of the first sharpening stone 4*a* relative to the vertical plane and/or when setting the second angle of the second sharpening stone 4*b* relative to the vertical plane.

The view holes 68*a*, 68*b* align with alternating angle indicators 70*a*, 70*b*. For example, the angle indicator 70*a* includes a listing for 10, 30, 50, and 62 degrees visible through the view hole 68*a* and the angle indicator 70*b* includes a listing for 0, 20, 40, 60, and 80 degrees visible through the view hole 68*b* at the appropriate angle between the holders 10*a*, 10*b* and the sharpening stones 4*a*, 4*b*. It will be appreciated that these specific angles are exemplary in nature, and the present disclosure encompasses any sharpening angle or set of sharpening angles. It is noted the base 8*b* may not be translucent or transparent where the base 8*b* includes the view holes 68*a*, 68*b*. It is noted the angle indicators 70*a*, 70*b* may correspond to the angle of the sharpening stone 4*a*, the angle of the sharpening stone 4*b*, or a combination of the two angles.

The interlocking assemblies 62*a*, 62*b* may be configured to hold the holders 10*a*, 10*b* at the desired angle. For example, the holders 10*a*, 10*b* may be secured at the desired angle through a tightening of the securing component 66*a*, 66*b*. It is noted, however, the base 8*b* may additionally or alternatively include self-locking components proximate to the holders 10*a*, 10*b* which prevent the rotation of the holders 10*a*, 10*b* absent an external force. By way of another example, the base 8*b* may be operable to receive securing devices (e.g., such as the setting device 50, screw 52, and/or screw 56) that engage with the base 8*b* and a respective holder 10*a*, 10*b*. In this regard, the base 8*b* may not require (or the base 8*b* may in addition use) a securing device such as the securing component 66*a*, 66*b* that assists in locking the holders 10*a*, 10*b* at the desired angle.

FIGS. 16-21 in general illustrate a sharpening device 2*c*, in accordance with one or more embodiments of the present disclosure. The sharpening device 2*c* is usable with a relatively low amount of skill and dexterity. The sharpening device 2*c* can be adjusted to provide a wide range of sharpening angles for use, allowing it to be adapted to the original angle of many different knives and tools. The sharpening device 2*c* has many features that are the same as, or similar to, the sharpening devices 2*a* and 2*b*. Moreover, the sharpening device 2*c* operates in a same or similar manner as the sharpening devices 2*a* and 2*b*.

Figure 16:
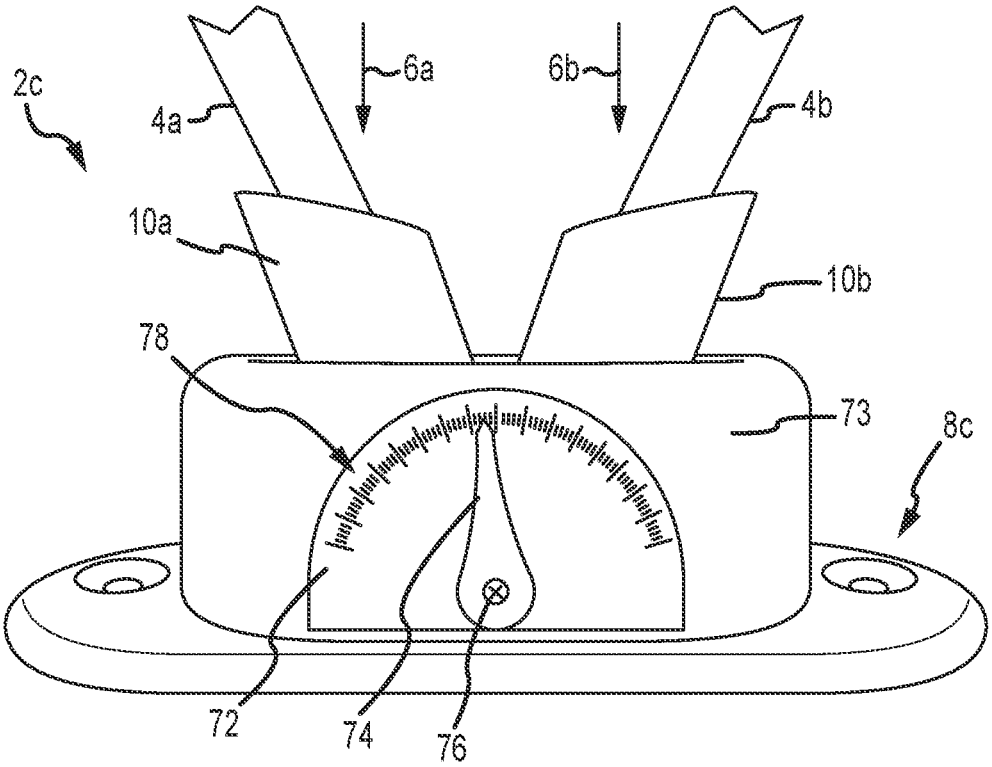
FIG. 16 is a front elevation view of an angle gauge and sharpening stones in first and second holders in a base of a sharpening device, according to embodiments of the present disclosure.
Figure 17:
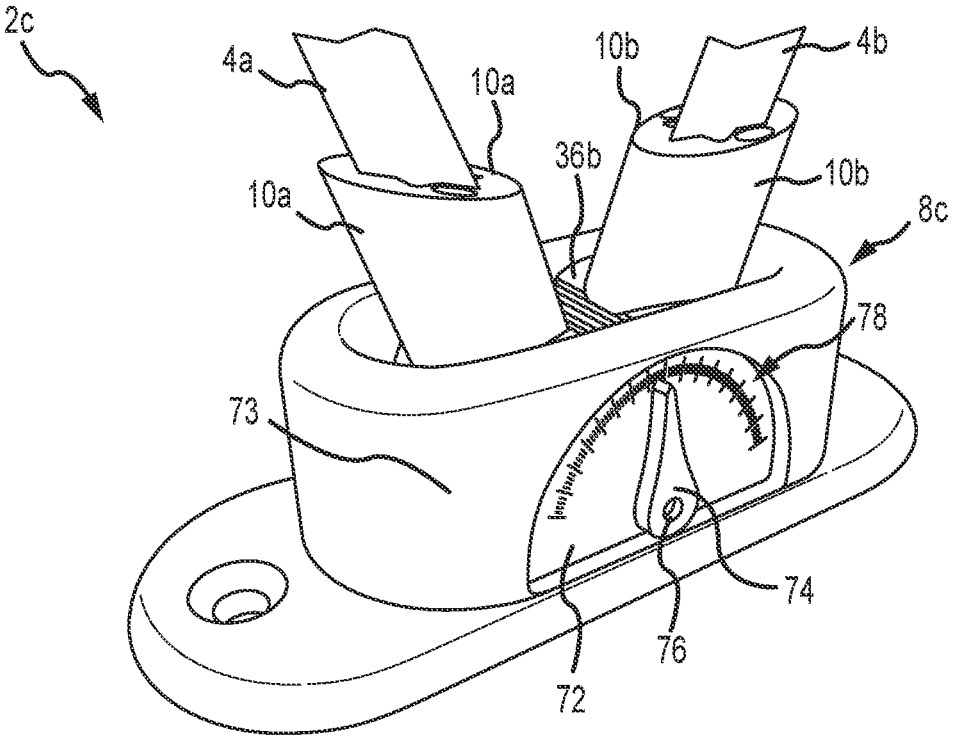
FIG. 17 is a front left perspective view of the sharpening device of FIG. 16.
Figure 18:
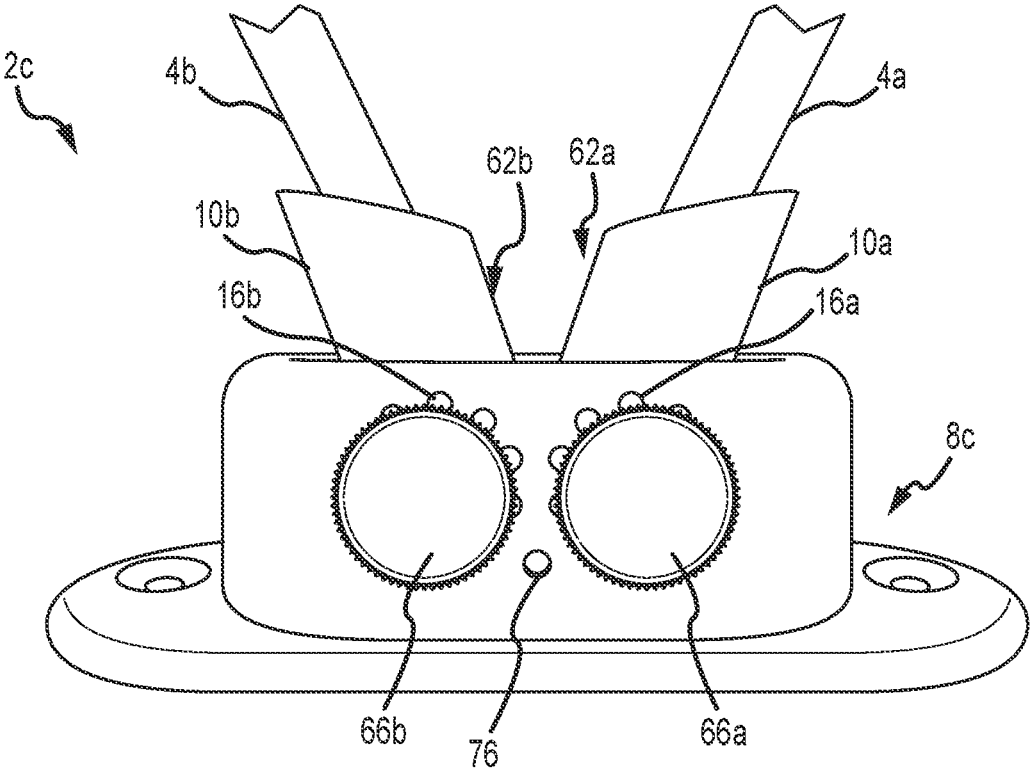
FIG. 18 is a rear elevation view of the sharpening device of FIG. 16.
Figure 19:
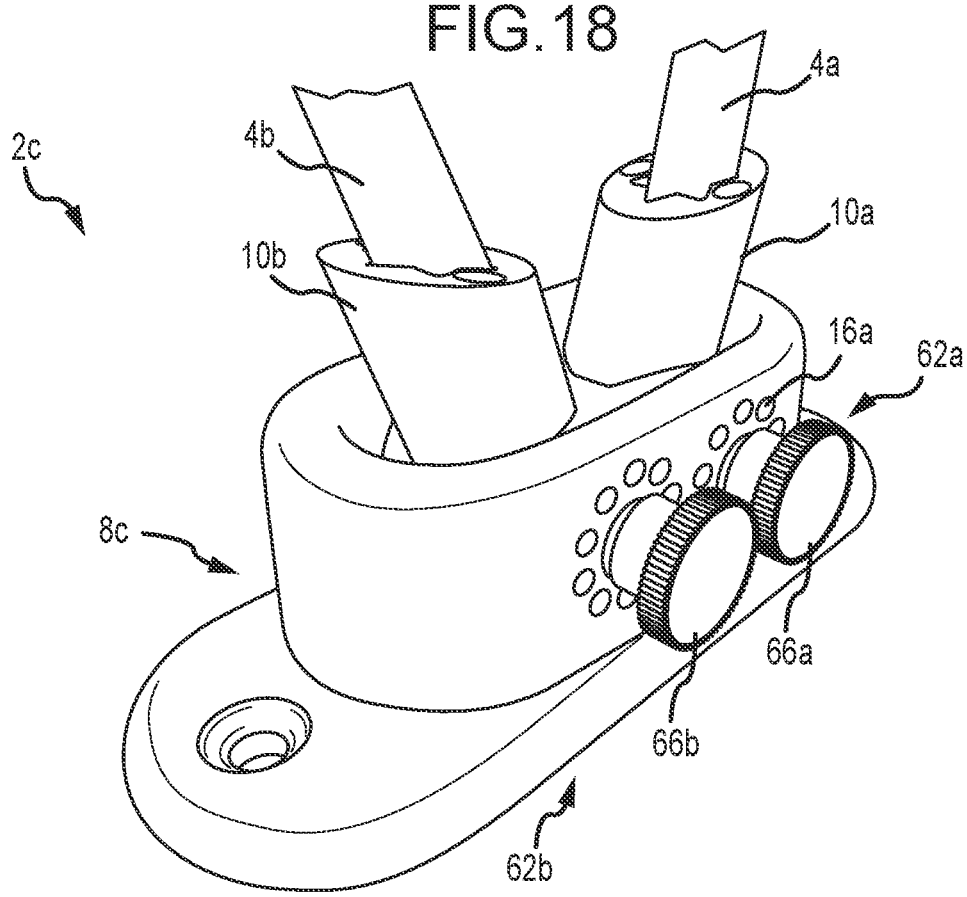
FIG. 19 is a rear right perspective view of the sharpening device of FIG. 16.
Figure 20:
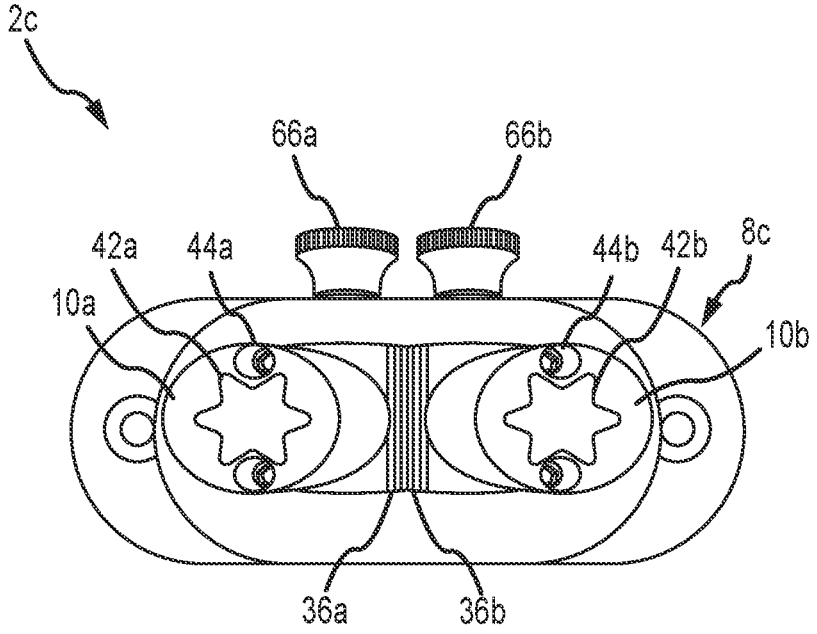
FIG. 20 is a top plan view of first and second holders in the base of the sharpening device of FIG. 16.

Referring now to FIG. 16, a base 8*c* of the sharpening device 2*c* is configured to receive the holders 10*a*, 10*b* for the sharpening stones 4*a*, 4*b* respectively. A user holding the edge of the tool against the sharpening stone 4*a*, 4*b* in a substantially vertical or downward direction such as shown for 6*a*, 6*b*, in combination with the ability to set the sharpening stones 4*a*, 4*b* at a particular desired angle, increases the ease of reproducing the correct sharpening motion for a particular tool edge as compared to known horizontal sharpening devices such as whetstones.

Referring generally to FIGS. 16-21, the holders 10*a*, 10*b* are held within the base 8*c* via corresponding interlocking assemblies 62*a*, 62*b*. The interlocking assemblies 62*a*, 62*b* may include a coupler 64*a*, 64*b* respectively (e.g., a pin, axle, threaded or non-threaded fastener, or the like) between the base 8*c* and the respective holders 10*a*, 10*b*. For example, the couplers 64*a*, 64*b* may be configured to enter through a first surface of the base 8*c*, pass through the holders 10*a*, 10*b*, and exit through a second surface of the base 8*c*.

In some embodiments, the axis of rotation for the holders 10*a*, 10*b* is co-axial with a central axis through the respective couplers 64*a*, 64*b*. In some embodiments of the present disclosure, a gasket or other space-filling device is inserted between the holders 10*a*, 10*b* and a respective inner surface of the base 8*c*, to assist in preventing movement of the holders 10*a*, 10*b* along the axis of rotation within the base 8*c* and/or to at least partially seal the base 8*c*.

In general, the coupler 64*a*, 64*b* may be an alignment device configured for defining and establishing concentricity of apertures in the base 8*c* and a respective holder 10*a*, 10*b*. The interlocking assemblies 62*a*, 62*b* may include a nut, knob, pin, or other securing component 66*a*, 66*b* to hold the coupler within the base 8*c*. Although embodiments illustrate the interlocking assemblies 62*a*, 62*b* are removable from the base 8*c*, it is noted the interlocking assemblies 62*a*, 62*b* may be a fixed as a riveted or machined assembly. In addition, it is noted each or either of the interlocking assemblies 62*a*, 62*b* may instead be a single fabricated component or constructed assembly, as described throughout the present disclosure.

The sharpening device 2*c* includes an angle gauge 72 positioned on an exterior surface 73 of the base 8*c*. In some embodiments, the angle gauge 72 may be formed with or otherwise integrated into the exterior surface 73 of the base 8*c* (e.g., an inset, relief area, or cavity within the exterior surface of the base 8*c*). In other embodiments, the angle gauge 72 may be formed with or otherwise integrated with the base 8*c* and extend outward from the exterior surface 73 of the base 8*c*. In other embodiments, the angle gauge 72 may be a separate component coupled (e.g., attached, connected, affixed, or the like) to the exterior surface of the base 8*c*.

The sharpening device 2*c* includes a pointer 74 within the angle gauge 72. The pointer 74 is set within the angle gauge 72 (e.g., where the angle gauge 72 is an inset, relief area, or cavity) or in front of the angle gauge 72 (e.g., where the angle gauge 72 extends outward from the exterior surface or is coupled to the exterior surface) and is rotated above a surface of the angle gauge 72 via a pointer axle 76 coupled (e.g., attached, connected, affixed, or the like) to internal gearing as described herein. The angle gauge 72 includes angle indicators 78 to which the pointer 74 points. For example, the angle indicators 78 may range between 0 degrees and 90 degrees. For instance, the angle indicators 78 may range between 0 degrees and 60 degrees. In general, the angle indicators 78 may range from any set of angles between 0 degrees and 180 degrees, in any increment of value (e.g., 1 degree, 2 degree, 5 degree, or the like). It is noted the angle indicators 78 may correspond to the angle of the sharpening stone 4*a*, the angle of the sharpening stone 4*b*, or a combination of the two angles.

It is noted the angle of each sharpening stone 4*a*, 4*b* relative to the definable vertical plane may be half the full angle as indicated on the angle gauge 72, where the sharpening stones 4*a*, 4*b* are evenly separated by the definable vertical plane (e.g., where a tool may be sharpened with the same angle on both sides of an edge of the tool). In other embodiments, the angle of each sharpening stone 4*a*, 4*b* relative to the definable vertical plane may be different (e.g., where a tool may be sharpened with a first angle on a first side of an edge of the tool, and a second, different angle on a second side of the edge of the tool). It will be appreciated that these specific angles are exemplary in nature, and the present disclosure encompasses any sharpening angle or set of sharpening angles. Setting the sharpening stones 4*a*, 4*b* at the same angle or at different angles relative to the definable vertical plane, in combination with holding the tool in the sharpening direction 6*a*, 6*b* shown (i.e., a substantially vertical orientation relative to the sharpening stones 4*a*, 4*b*), increases the ease of reproducing the correct sharpening motion for a particular tool edge as compared to known horizontal sharpening devices such as whetstones.

Figure 21:
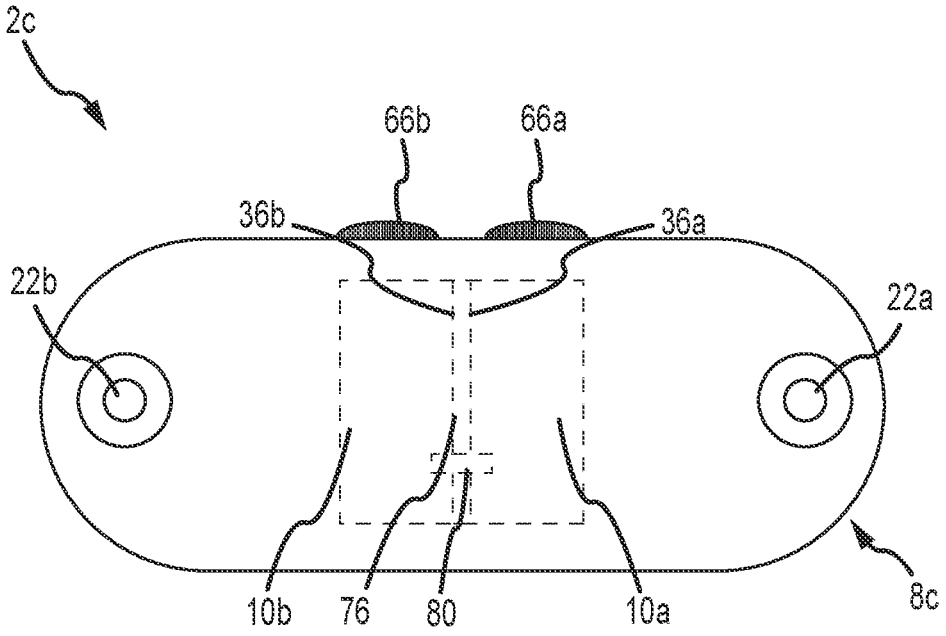
FIG. 21 is a bottom plan view of the base of the sharpening device of FIG. 16.
Figure 22:
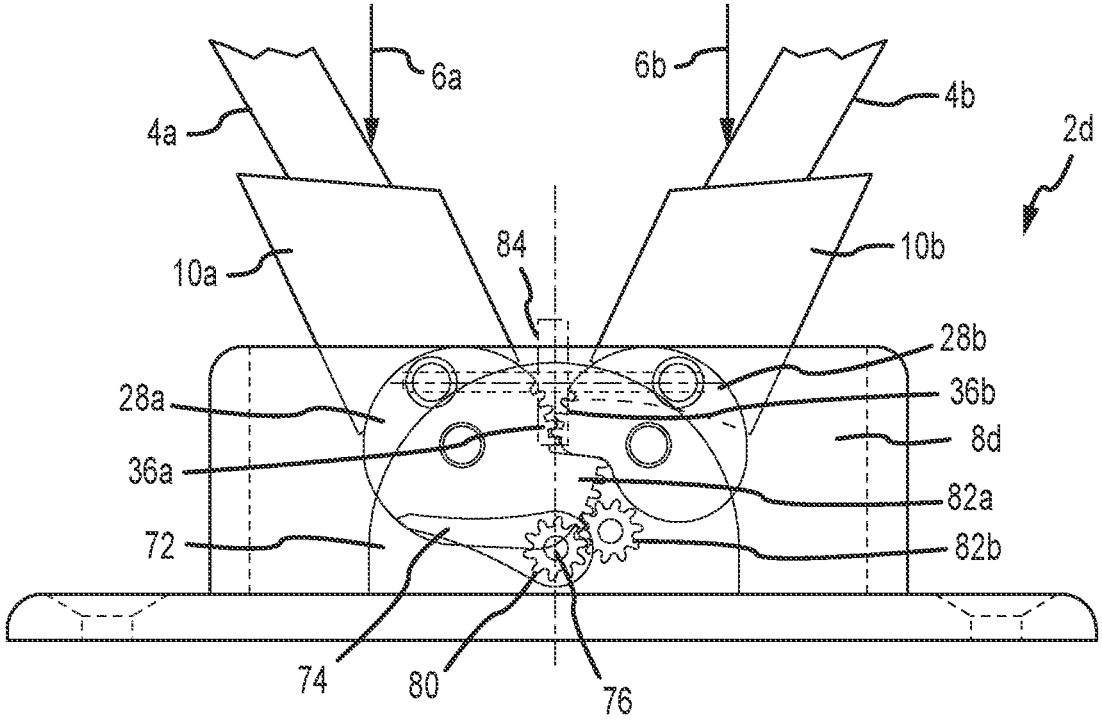
FIG. 22 is a front elevation view of an angle gauge and sharpening stones in first and second holders in a base of a sharpening device, according to embodiments of the present disclosure.
Figure 23:
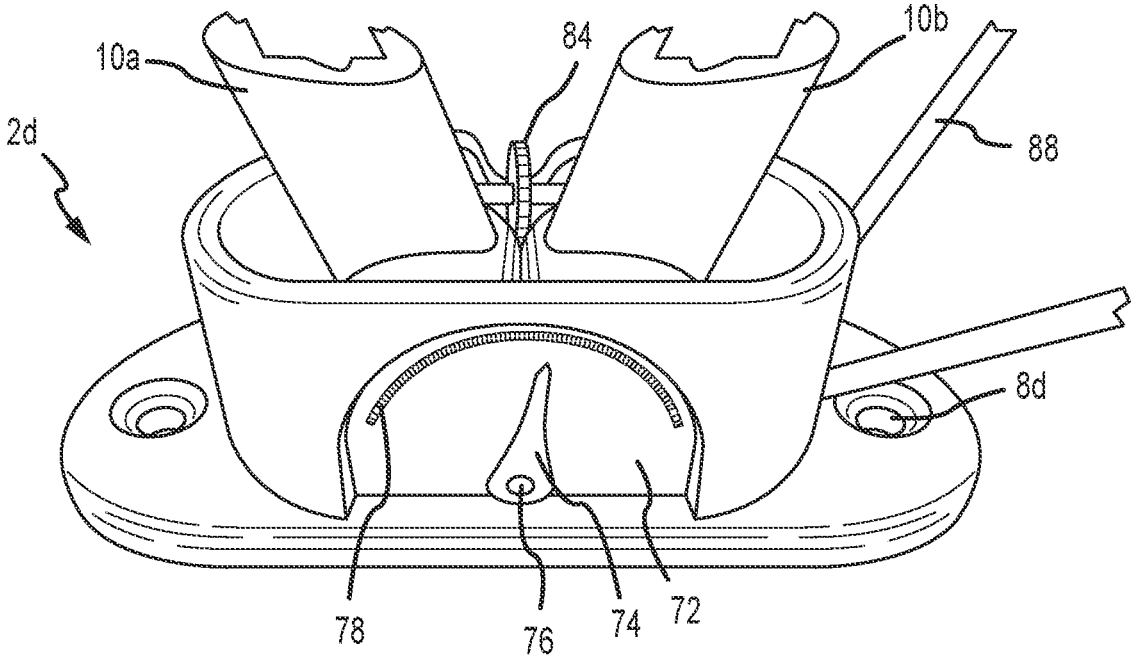
FIG. 23 is a front top perspective view of the sharpening device of FIG. 22.
Figure 24:
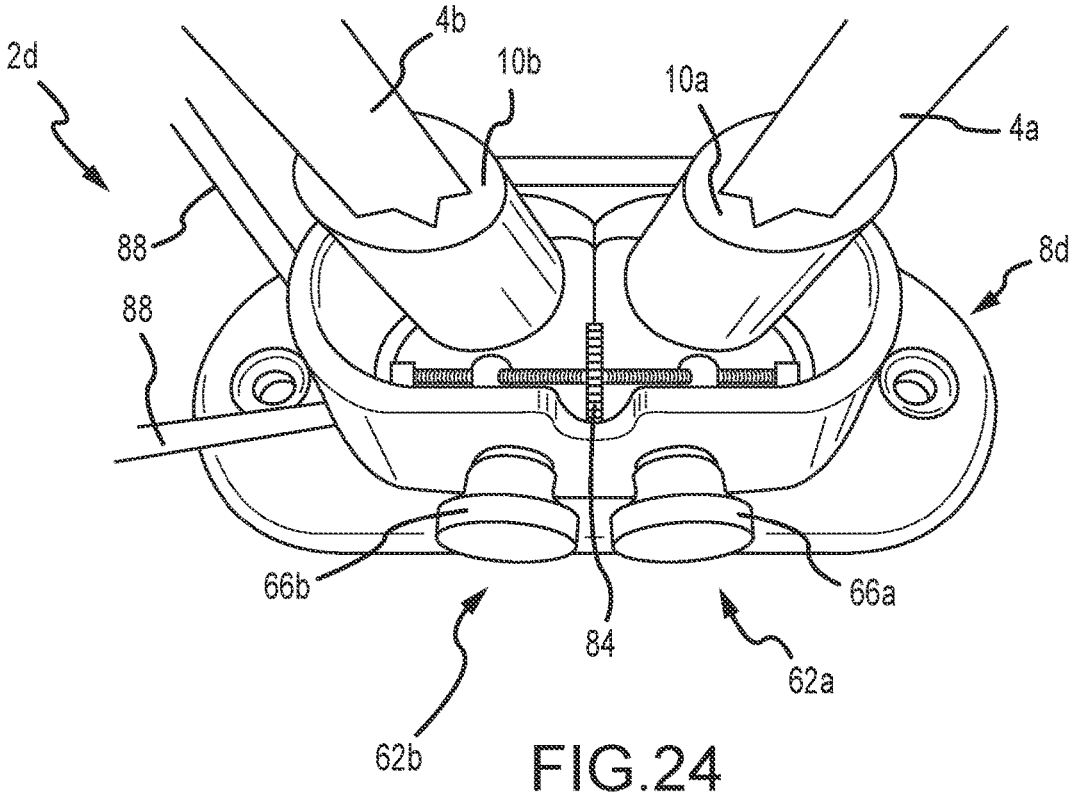
FIG. 24 is a rear top perspective view of the sharpening device of FIG. 22.
Figure 25:
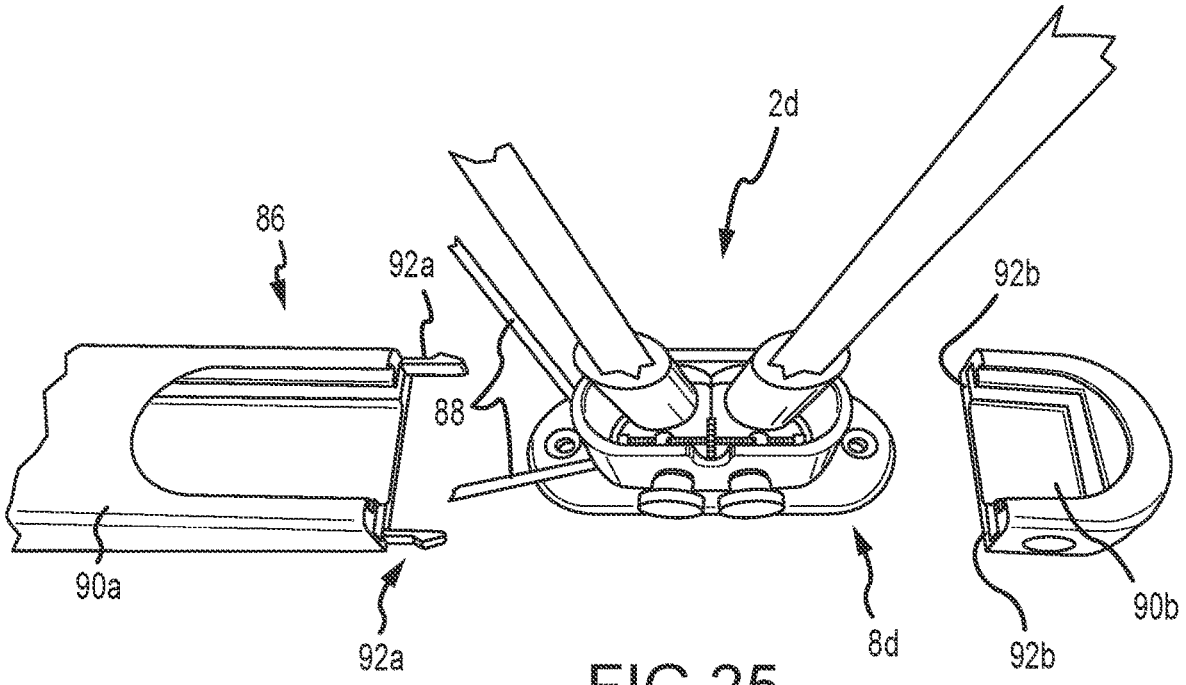
FIG. 25 is a rear top perspective view of the sharpening device of FIG. 22 with a base stand in a separated configuration, according to embodiments of the present disclosure.
Figure 26:
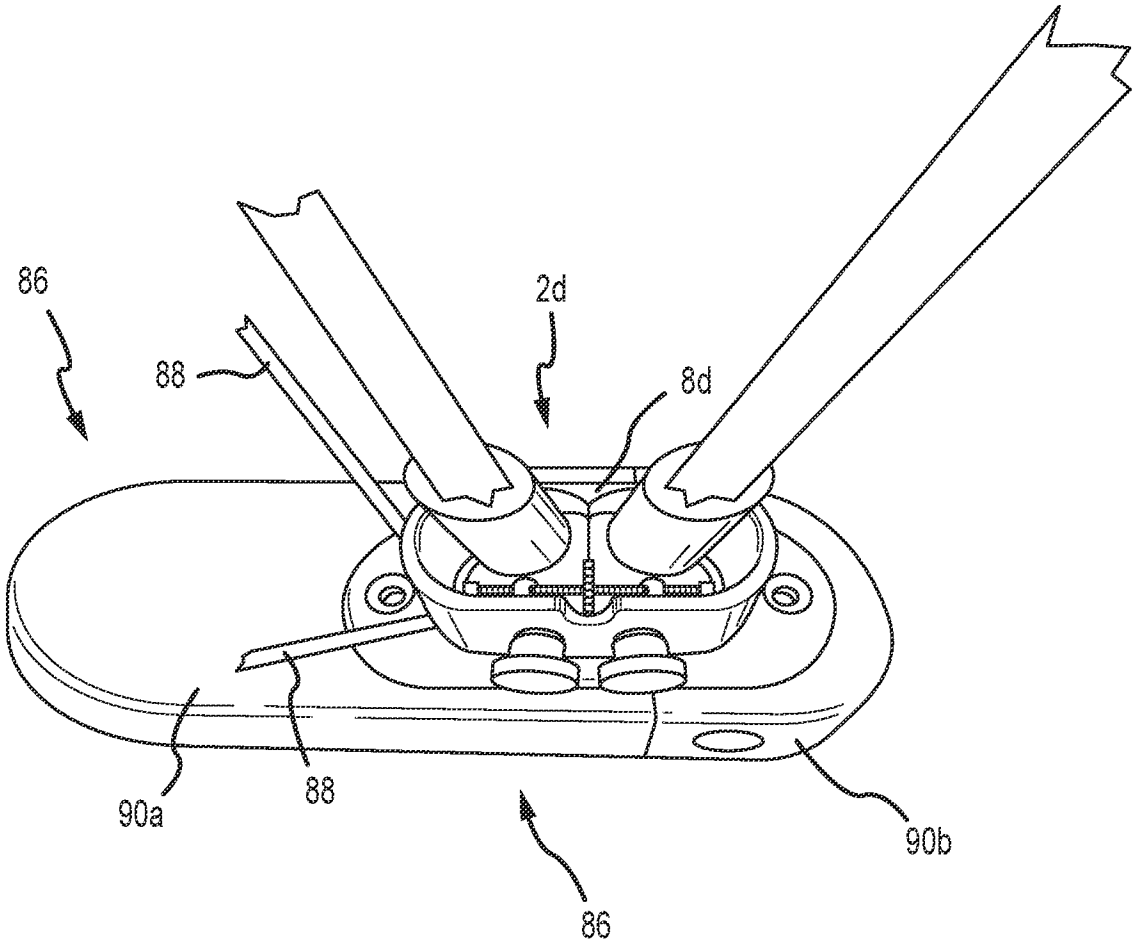
FIG. 26 is a rear top perspective view of the sharpening device and the base stand of FIG. 25 in an assembled configuration.

As illustrated in broken lines in FIG. 21, the pointer 74 is coupled to a pointer gear 80 via the pointer axle 76, such that the pointer 74 is able to rotate about an axis through the pointer axle 76 when the pointer gear 80 rotates. The gear surfaces 36*a* and/or 36*b* on the lower portions 28*a* and/or 28*b* are shaped to provide space for the pointer gear 80 to operate, and are inset within the base 8*c* to prevent the pointer gear assembly (e.g., the pointer gear 80, the pointer 74, and the pointer axle or connecting axle 76) from falling out of the base 8*c*. The pointer gear 80 may run along a portion of or for the entire width of the cavity defined within the base 8*c*, and may engage the gear surfaces 36*a* and/or 36*b* on the lower portions 28*a* and/or 28*b*. In this regard, rotational motion of the gear surfaces 36*a* and/or 36*b* (e.g., either directly actuated via a force applied to the sharpening stones 4*a*, 4*b* and/or holders 10*a*, 10*b*, or indirectly actuated via a force applied by the meshed gear surfaces 36*a* and/or 36*b* that is transferred from the force applied to the sharpening stones 4*a*, 4*b* and/or holders 10*a*, 10*b*) is transferred to the pointer gear 80. Rotational motion of the pointer gear 80 is similarly transferred to the pointer 74 via the pointer axle 76.

FIGS. 22-26 in general illustrate a sharpening device 2*d*, in accordance with one or more embodiments of the present disclosure. The sharpening device 2*d* is usable with a relatively low amount of skill and dexterity. The sharpening device 2*d* can be adjusted to provide a wide range of sharpening angles for use, allowing it to be adapted to the original angle of many different knives and tools. The sharpening device 2*d* has many features that are the same as, or similar to, the sharpening devices 2*a*-2*c*. Moreover, the sharpening device 2*d* operates in a same or similar manner as the sharpening devices 2*a*-2*c*.

A base 8*d* of the sharpening device 2*d* is configured to receive the holders 10*a*, 10*b* for the sharpening stones 4*a*, 4*b* respectively. A user holding the edge of the tool against the sharpening stone 4*a*, 4*b* in a substantially vertical or downward direction such as shown for 6*a*, 6*b*, in combination with the ability to set the sharpening stones 4*a*, 4*b* at a particular desired angle, increases the ease of reproducing the correct sharpening motion for a particular tool edge as compared to known horizontal sharpening devices such as whetstones.

As similarly described with respect to FIGS. 16-21, the pointer 74 is coupled to the pointer gear 80. The gear surfaces 36*a* and/or 36*b* on the lower portions 28*a* and/or 28*b* are shaped to provide space for the pointer gear 80 to operate, and are inset within the base 8*d* to prevent the pointer gear assembly (e.g., the pointer gear 80, the pointer 74, and the pointer axle or connecting axle 76) from falling out of the base 8*d*. The pointer gear 80 may run along a portion of or for the entire width of the cavity defined within the base 8*d*, and may engage the gear surfaces 36*a* and/or 36*b* on the lower portions 28*a* and/or 28*b*.

In FIGS. 22-26, the pointer gear 80 also interfaces with secondary gears 82*a*, 82*b* in the base 8*d*. The secondary gears 82*a*, 82*b* are turned by the rotation of the gear surfaces 36*a* and/or 36*b*, respectively, and the pointer gear 80 is similarly turned by the rotation of the secondary gears 82*a*, 82*b*. In this regard, the pointer 74 indicates the angle formed between the holders 10*a*, 10*b* and the sharpening stones 4*a*, 4*b*. It is noted the secondary gears 82*a*, 82*b* may be configured or shaped to interfere with one another and prevent over rotation. In this regard, rotational motion of the gear surfaces 36*a* and/or 36*b* is transferred to the pointer gear 80. Rotational motion of the pointer gear 80 is similarly transferred to the pointer 74 via the pointer axle 76.

The gearing assembly (e.g., including, but not limited to, the gear surfaces 36*a*, 36*b*, the secondary gears 82*a*, 82*b*, and the pointer gear 80) are coupled (e.g., via interlocking or meshing gear surfaces) to a thumb screw or thumb wheel 84. In some embodiments, the thumb screw or thumb wheel 84 is positioned between the holders 10*a*, 10*b*. In other embodiments, the thumb screw or thumb wheel 84 is positioned to an exterior side of one of the holders 10*a*, 10*b*.

The thumb screw or thumb wheel 84 is configured to actuate the holders 10*a*, 10*b* via the gearing assembly, which changes the angle between the holders 10*a*, 10*b*. The change in angle from a first angle to a second angle (or first angle indicator to second angle indicator) is indicated on the angle gauge 72 by the pointer 74. It is noted, however, that the thumb screw or thumb wheel 84 may be directly coupled to and configured to act on the holders 10*a*, 10*b* instead of via the gearing assembly, such that actuation of the thumb screw or thumb wheel 84 moves the holder 10*a* and/or 10*b* and the gearing assembly independently moves the pointer 74 in the angle gauge 72. In addition, it is noted that the secondary gears 82*a*, 82*b* may mesh so as to provide a positive rotational stop when opening without relying on the thumb screw or thumb wheel 84 as a stopping mechanism.

It will be appreciated the specific gearing assembly arrangement as illustrated in FIGS. 16-21 and 22-26 is exemplary in nature, and the present disclosure encompasses any gearing assembly usable to transfer an adjustment of the holders 10*a*, 10*b* (e.g., opposite rotations of the holders 10*a*, 10*b* about respective couplers) into a rotation of the pointer 74 to indicate a change of angle between the holders 10*a*, 10*b* and the sharpening stones 4*a*, 4*b*. For example, the thumb screw or thumb wheel 84 may only cause the holder 10*a* or the holder 10*b* to move. In general, the holder 10*a* or 10*b* may be configured to individually move, allowing for the adjustment of a single sharpening stone 4*a* or 4*b* instead of simultaneously moving both holders 10*a*, 10*b* and sharpening stones 4*a*, 4*b*. It is noted this may be beneficial where the sharpening stones 4*a*, 4*b* are set up for sharpening the sides of the edge of the tool with different angles (e.g., a serrated knife, or other tool).

The base 8*d* fits within a base stand 86 (e.g., stand, cover, box, or the like). For example, the base 8*d* may include one or more dimensions which correspond to dimensions (e.g., of defined cavities, outer perimeters, or the like) of the base stand 86, such that at least a portion of the base 8*d* (e.g., a bottom portion) may be selectively retained within the base stand 86. The base stand 86 may be adjustable or be fixed. The base stand 86 may be arrange for left-handed use, right-handed use, or have the base 8*d* be centered within. The base stand 86 may house sharpening stones 4*a*, 4*b*, gauge plates 12, safety rods 88, or the like. For example, the gauge plates 12 may each include an outer perimeter that fits within and is selectively removable from an outer perimeter of or defined cavity within the base stand 86. The base stand 86 may include stand portions 90*a*, 90*b* which separate and reconnect via mechanical latches or detents 92*a*, 92*b*. It is noted, however, the base stand 86 may slide or otherwise connect onto the base 8*d* in a single piece.

In some embodiments, the safety rods (also called hand guards herein) 88 extend at least partially in a direction outward and/or upward from the base 8*d*. The safety rods or hand guards 88 are fabricated from a material able to prevent a tool edge from engaging with a hand of a user. For example, the material may include, but is not limited to, a metal or plastic of a sufficient hardness to prevent a tool edge from cutting through the safety rods 88, a stone material (e.g., similar to the sharpening stone 4*a*, 4*b*), or the like. It is noted that where the sharpening device 2*d* comes with multiple sets of sharpening stones 4*a*, 4*b*, that the base 8*d* and/or the base stand 86 may include apertures operable to receive the sharpening stones 4*a*, 4*b* not in use for sharpening.

It is to be appreciated that the various embodiments of the present disclosure may be calibrated to any range of angles as desired as shown by a setting device 50 with accompanying aligned apertures 48 including sets of apertures 16 and 34, view holes 68 and angle indicators 70, and/or an angle gauge 72. In one non-limiting example, the setting device 50 with accompanying aligned apertures 48 including sets of apertures 16 and 34, the view holes 68 and angle indicators 70, and/or the angle gauge 72 may be calibrated as a zero angle or a non-zero angle when the sharpening stones 4*a*, 4*b* are vertical or substantially vertical.

It is to be appreciated that any embodiments of the present disclosure as illustrated with respect to the sharpening devices 2*a*, 2*b*, 2*c*, 2*d* may be combinable with any other embodiment of the sharpening devices 2*a*, 2*b*, 2*c*, 2*d*, without departing from the scope of the present disclosure. In one non-limiting example, any sharpening device 2 as described throughout the present disclosure may include a setting device 50 with accompanying aligned apertures 48 including sets of apertures 16 and 34, view holes 68 and angle indicators 70, and/or an angle gauge 72. In another non-limiting example, any sharpening device 2 as described throughout the present disclosure may include one or more gauge plates 12, geared surfaces 36, securing components 66, a thumb screw or thumb wheel 84, a base stand 86, and/or hand guards or safety rods 88.

For example, in embodiments as depicted in FIGS. 9A-15, 16-21, and 22-26, in addition to or instead of the securing components 66*a*, 66*b* to prevent rotation of the holders 10*a*, 10*b*, the base 8*c* includes apertures 16*a*, 16*b* and the holders 10*a*, 10*b* includes apertures 34*a*, 34*b* which are operable to receive a setting device 50, screw 52, and/or screw 56. In non-limiting examples as depicted in FIGS. 16-21 and 22-26, the angle gauge 72 may be on a first (e.g., front) surface of the base 8*c*, the apertures 16*a*, 16*b* and corresponding apertures 34*a*, 34*b* in the holders 10*a*, 10*b* may be on a second (e.g., rear) surface of the base 8*c*.

It will be appreciated that embodiments of the present disclosure are not limited to aligned apertures 48. In addition, it is to be appreciated that any of the sharpening devices 2*a*, 2*b*, 2*c*, 2*d* as described throughout the present disclosure may employ recesses, detents, and bias members. In one non-limiting example, while other holders 10 described herein have apertures 34*a*, 34*b* that extend completely through the holders 10*a*, 10*b*, the holders 10*a*, 10*b* may instead have a plurality of recesses that partially extend into the holders 10*a*, 10*b*. These recesses may be located in the same positions as, for example, the apertures 34*a*, 34*b* shown in FIGS. 4A and 4B, and may at least partially house detents and a bias member operable to cause the detents to move within the recesses to engage apertures 16*a*, 16*b* within the base 8*a*. In this embodiment, the holders 10*a*, 10*b* may be positioned in a base 8*a* that has apertures 16*a*, 16*b* in the same position as shown in FIG. 2A. A detent on the holder 10*a*, 10*b* may be aligned with an aperture 16*a*, 16*b* on the base 8*a* at a given position, and the detent extends into the aperture 16*a*, 16*b* to establish the angle of the holders 10*a*, 10*b* and a sharpening stones 4*a*, 4*b* extending from the holders 10*a*, 10*b*. The remaining detents of the holders 10*a*,

10*b* are not aligned with any aperture 16*a*, 16*b* of the base 8*a*, and therefore, remain deflected in their respective recesses. In this embodiment, no setting device 50 is needed to lock the holders 10*a*, 10*b* in the desired position (e.g., angle).

The detent is positioned in a recess, and a bias member is positioned between a rear surface of the detent and an inner surface of the recess to bias the detent in an outward direction. The bias members can produce a force in response to physical displacement in a linear or nonlinear manner in various embodiments. The detent can have a lip that corresponds to a lip of the recess to prevent the detent from falling out of the holders 10*a*, 10*b*. To initially position the detent in the recess, the detent can be pressed in to partially deflect the detent, the holders 10*a*, 10*b*, or both to position the detent in the recess. In other embodiments, apertures extend through the holders 10*a*, 10*b* instead of recesses. The aperture has a larger diameter at one end than an opposing end to establish the lip described above. The detent can enter the aperture from the side with the larger diameter and is then bolted, plugged, or otherwise secured in place.

The detent also has a rounded distal surface so that a predetermined rotational force caused by a user rotating the holders 10*a*, 10*b* will drive the detent into a portion of the base, which then drives the detent into its recess. A first detent engages a corresponding recess or aperture in the base 8*a* to establish the angle of the holders 10*a*, 10*b*. A second detent is not aligned with any recess or aperture 16*a*, 16*b* of the base 8*a*. In additional embodiments, the holders 10*a*, 10*b* may have a single detent that selectively enters recesses or apertures in the base to establish the angle of the holders 10*a*, 10*b* and the sharpening stones 4*a*, 4*b*. In other embodiments, the detent is positioned in the inner surface of the base 8*a*, and this detent, or multiple detents, selectively engages recess or apertures 16*a*, 16*b* on the holders 10*a*, 10*b*.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

Any one or more aspects described herein can be combined with any other one or more aspects described herein. Any one or more features described herein can be combined with any other one or more features described herein. Any one or more embodiments described herein can be combined with any other one or more embodiments described herein. It is to be appreciated that any feature described herein can be claimed in combination with any other feature(s) as described herein, regardless of whether the features come from the same described embodiment.

What is claimed is:

1. A sharpening device for sharpening a blade of a tool, comprising:

a base having a bottom surface, a sidewall with a first plurality of apertures extending through a first portion of the sidewall, and a first center aperture, wherein the first plurality of apertures is arranged in a first circle having a first radius and the first center aperture is positioned at a first center point of the first circle;

a vertical plane positioned substantially perpendicular to the bottom surface of the base;

a first holder having a first recess configured to receive a first sharpening stone, a second plurality of apertures extending into a side portion of the first holder, and a second center aperture, wherein the second plurality of apertures are arranged in a second circle having a second radius and the second center aperture is positioned at a second center point of the second circle, wherein the first radius is equal to the second radius, and wherein the first sharpening stone is capable of being set at a first angle relative to the vertical plane via rotation of the first holder about a first rotation axis;

a first coupler extending through the second center aperture of the first holder and the first center aperture of the base such that the first holder is rotatable relative to the base about the first coupler and the first rotation axis, wherein when the first sharpening stone is positioned at the first angle relative to the vertical plane, one aperture of the first plurality of apertures is aligned with one aperture of the second plurality of apertures;

a second holder having a second recess configured to receive a second sharpening stone, the second holder having a third center aperture, wherein the second sharpening stone is capable of being set at a second angle relative to the vertical plane via rotation of the second holder; and a second coupler extending through the third center aperture of the second holder and a fourth center aperture of the base such that the second holder is rotatable relative to the base about the second coupler and a second rotation axis.

2. The sharpening device of claim 1, wherein the first center point of the first circle and the second center point of the second circle are aligned with the first rotation axis of the first holder.

3. The sharpening device of claim 1, wherein the second holder has a third plurality of apertures and the base has a fourth plurality of apertures, wherein the third plurality of apertures are arranged in a third circle having a third radius, wherein the fourth plurality of apertures are arranged in a fourth circle having a fourth radius, wherein the third radius is equal to the fourth radius, and wherein when the second sharpening stone is positioned at the second angle relative to the vertical plane, one aperture of the third plurality of apertures is aligned with one aperture of the fourth plurality of apertures.

4. The sharpening device of claim 1, wherein the first holder includes a first geared surface that is operable to engage with a second geared surface of the second holder, wherein rotation of the first holder in one direction relative to the vertical plane causes rotation of the second holder in an opposing direction relative to the base when the first geared surface is engaged with the second geared surface, and wherein the second angle of the second sharpening stone is equal and opposite to the first angle of the first sharpening stone relative to the vertical plane.

5. The sharpening device of claim 1, wherein the first holder includes a first geared surface that is operable to engage with a second geared surface of the second holder, wherein rotation of the first holder in one direction relative to the vertical plane causes rotation of the second holder in an opposing direction relative to the base when the first geared surface is engaged with the second geared surface, and wherein the second angle of the second sharpening stone is different from the first angle of the first sharpening stone relative to the vertical plane.

6. The sharpening device of claim 1, further comprising at least one of:

a gauge plate coupled to the base, and wherein the gauge plate has indicia that identifies the first angle, the second angle, or a combination of the first angle and the second angle; or a plurality of gauge plates operable to be positioned proximate to the first sharpening stone and the second sharpening stone, wherein each gauge plate of the plurality of gauge plates is dimensioned to identify the first angle, the second angle, or a combination of the first angle and the second angle.

7. The sharpening device of claim 1, further comprising a base stand including a cavity dimensioned to receive a bottom portion of the base.

8. The sharpening device of claim 1, further comprising at least one safety rod that extends outwardly and upwardly from the base to prevent an edge of the blade of the tool from engaging with a hand of a user.

* * * * *